US009017532B2

(12) United States Patent
Wright et al.

(10) Patent No.: US 9,017,532 B2
(45) Date of Patent: Apr. 28, 2015

(54) ELECTROPLATING PROCESS, SYSTEM AND COMPONENTS THEREOF

(76) Inventors: Bradley A. Wright, Scarborough (CA); Rudy M. Koehler, York (CA)

( * ) Notice: Subject to any disclaimer, the term of this patent is extended or adjusted under 35 U.S.C. 154(b) by 628 days.

(21) Appl. No.: 13/240,699

(22) Filed: Sep. 22, 2011

(65) Prior Publication Data

US 2013/0075252 A1 Mar. 28, 2013

(51) Int. Cl.

| | |
|---|---|
| ***B23H 7/26*** | (2006.01) |
| ***C25D 17/00*** | (2006.01) |
| ***C25D 17/08*** | (2006.01) |

(52) U.S. Cl.

CPC ..... *C25D 17/08* (2013.01); *Y10T 29/49826* (2015.01)

(58) Field of Classification Search

CPC ..... C25D 17/06; C25D 17/08; Y10S 269/00; Y10S 269/91; B23H 7/26

USPC ..... 118/500; 269/47, 46, 289 R, 309; 205/183, 184, 186, 187; 204/297.01, 204/297.06; 211/123

See application file for complete search history.

(56) References Cited

U.S. PATENT DOCUMENTS

| | | | | |
|---|---|---|---|---|
| 2,364,822 | A * | 12/1944 | Schneider | 204/297.09 |
| 3,033,776 | A | 5/1962 | Rosner | |
| 3,923,631 | A | 12/1975 | Palisin, Jr. | |
| 3,972,798 | A | 8/1976 | Palisin, Jr. | |
| 4,176,039 | A | 11/1979 | Wismer | |
| 4,297,197 | A | 10/1981 | Salman | |
| 4,872,963 | A | 10/1989 | Van Horn | |
| 5,702,584 | A * | 12/1997 | Goenka et al. | 205/158 |
| 7,442,285 | B2 * | 10/2008 | Brondum | 205/192 |

OTHER PUBLICATIONS

Dictionary.com (Sever definition).*

* cited by examiner

*Primary Examiner* — Luan Van
*Assistant Examiner* — Alexander W Keeling
(74) *Attorney, Agent, or Firm* — McMillan LLP

(57) ABSTRACT

An electroplating system and components thereof facilitate an efficient electroplating process which in part reduces or eliminates the number of clips used on electroplating racks. Some electroplating racks may use skewers on which multiple plastic pieces are typically mounted. The plastic pieces may also be configured to be joined to form an assembly which is mounted on an electroplating rack. The configurations help reduce the time spent loading and unloading pieces on the racks.

5 Claims, 34 Drawing Sheets

ELECTROPLATING PROCESS, SYSTEM AND COMPONENTS THEREOF

BACKGROUND OF THE INVENTION

1. Technical Field

The present invention relates generally to the electroplating on plastic process, system and components thereof including plastic parts which are electroplated. More particularly, the present invention relates to electroplating racks and plastic parts configured for mounting thereon whereby the racks substantially reduce or eliminate the use of clips and reduce the time required for loading and unloading the plastic pieces from the rack.

2. Background Information

Electroplating is a plating process that uses electrical current to reduce cations of a desired material from a solution and coat a conductive object with a thin layer of the material, such as a metal. Electroplating is primarily used for depositing a layer of material to bestow a desired property (for example, abrasion and wear resistance, corrosion protection, lubricity, aesthetic qualities, etc.) to a surface that otherwise lacks that property.

The process used in electroplating is called electrodeposition. It is analogous to a galvanic cell acting in reverse. The part to be plated is the cathode of the circuit. In one technique, the anode is made of the metal to be plated on the part. Both components are immersed in a solution called an electrolyte containing one or more dissolved metal salts as well as other ions that permit the flow of electricity. A power supply supplies a direct current to the anode, oxidizing the metal atoms that comprise it and allowing them to dissolve in the solution. At the cathode, the dissolved metal ions in the electrolyte solution are reduced at the interface between the solution and the cathode, such that they "plate out" onto the cathode. The rate at which the anode is dissolved is equal to the rate at which the cathode is plated, vis-a-vis the current flowing through the circuit. In this manner, the ions in the electrolyte bath are continuously replenished by the anode.

Plastic parts can be plated with many finishes such as nickel, chrome or other metals. The raw plastic part is attached to a metal rack that is immersed into various tanks. In some of these tanks, the racks are supplied with electric current. The rack with the plastic parts go into an acid bath that chemically etches the surface of the part. After various cleaning tanks, the rack goes into a bath with a suspension of copper that attaches to the rough surfaces—this process is called deposition. Once enough copper is on the part surface and the rack clips are in electrical connection with the part surface, the part is electrically conductive and the rack can go into the electrodeposition tanks and receive the final metallic coating or coatings of nickel, chrome or other metals.

Most high volume applications use dedicated plating racks which in today's market can cost well over $1000 each and last only 1000 cycles before needing to be replaced or rebuilt. Once welded together with all the clips in the correct locations, the rack is immersed in a plastic material such as Plastisol to coat the part of the rack that will be immersed in the tanks. The plastic material around the clip jaws is mechanically removed so that the end of the clip is exposed, conductive and can mechanically grab the part.

For large parts sold at relatively higher prices, manually loading and unloading the racks is a small aspect of the overall part cost, but for small parts, one of the larger costs involved is the manual loading and unloading. In addition, the longer it takes for loading and unloading, the more racks will be needed to keep up with the processing speed of the plating system.

BRIEF SUMMARY OF THE INVENTION

The present invention provides an electroplating system comprising an electroplating rack comprising an electrically conductive frame member; and a longitudinal skewer which is cantilevered from and in electrical communication with the frame member and adapted to carry a plurality of molded plastic pieces during electroplating of the pieces.

The present invention also provides a method comprising the steps of providing a plurality of plastic pieces comprising first, second and third plastic pieces; joining a joining part of the first piece with a joining part of the second piece to form a two-piece assembly; joining a joining part of the second piece of the two-part assembly with a joining part of the third piece to form a three-piece assembly; mounting the three-piece assembly on an electroplating rack to form an electroplating assembly in which the first, second and third pieces of the three-piece assembly are prepared to be electroplated.

The present invention further provides an electroplating system comprising an electroplating rack comprising a first electrically conductive member and a second electrically conductive member spaced from the first conductive member; a plurality of identical plastic pieces which are movable between an unjoined position in which the pieces are separate from one another and a joined position in which the pieces are joined to form a joined assembly; wherein the joined assembly comprises a first plastic piece in contact with the first conductive member at a first connection, a second piece in contact with the second conductive member at a second connection, and at least one intermediate plastic piece between the first and second pieces whereby the first and second connections are the only connections between the joined assembly and the rack.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

FIG. 1 shows several concatenated assemblies of the molded plastic pieces mounted on several of the upper skewer assemblies.

FIG. 10 shows the bushing of the skewer assembly extending outwardly from the front skewer supporting bar of the rack frame.

FIG. 21 is thus viewed parallel to the second embodiment of the skewer as viewed from the free end looking toward the secured end thereof.

Similar numbers refer to similar parts throughout the drawings.

DETAILED DESCRIPTION OF THE INVENTION

Figure 1:
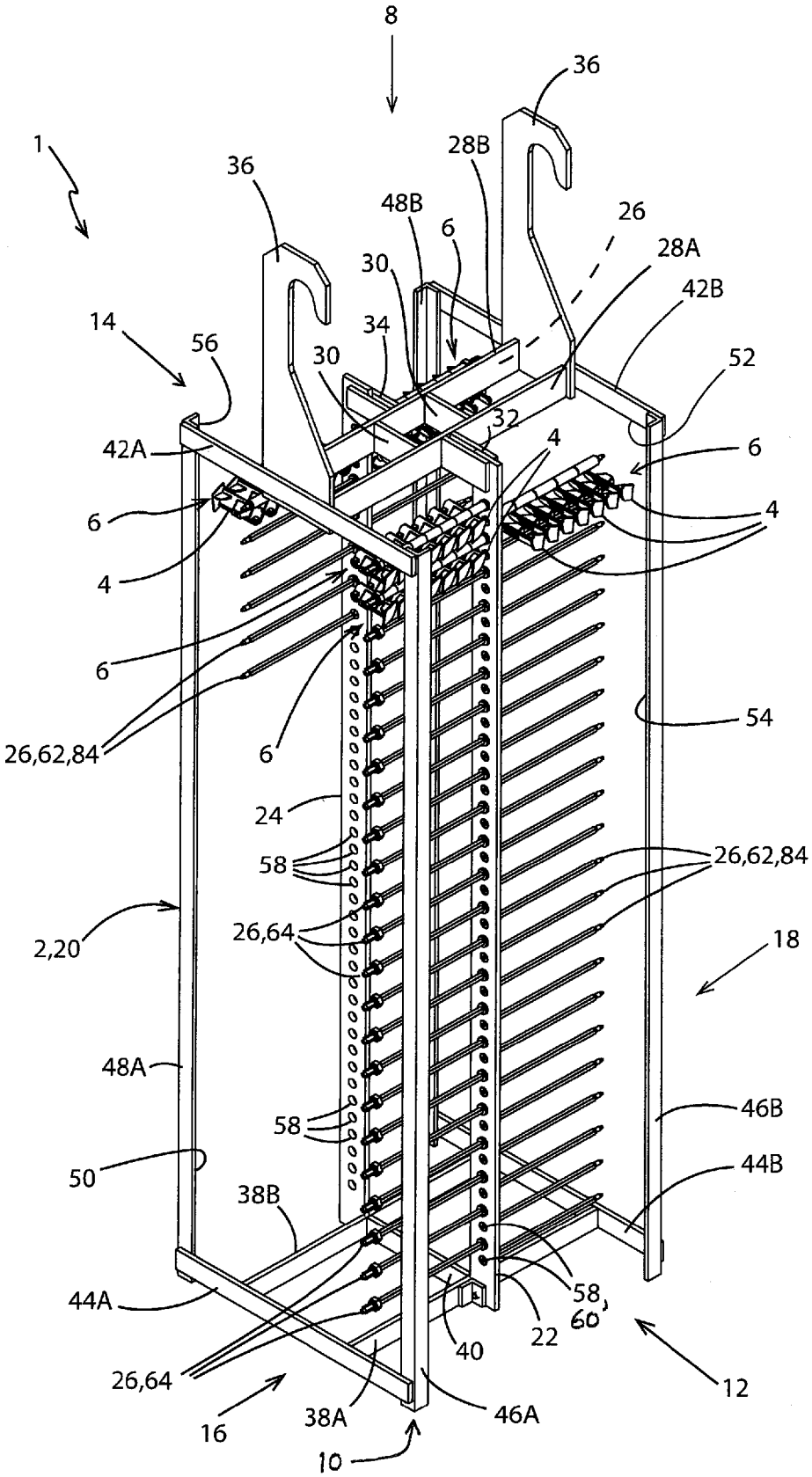
FIG. 1 is a perspective view taken from the front, left and above of a first embodiment of the electroplating rack of the present invention with the outer coating and several of the rear skewer assemblies removed for clarity.
Figure 15:
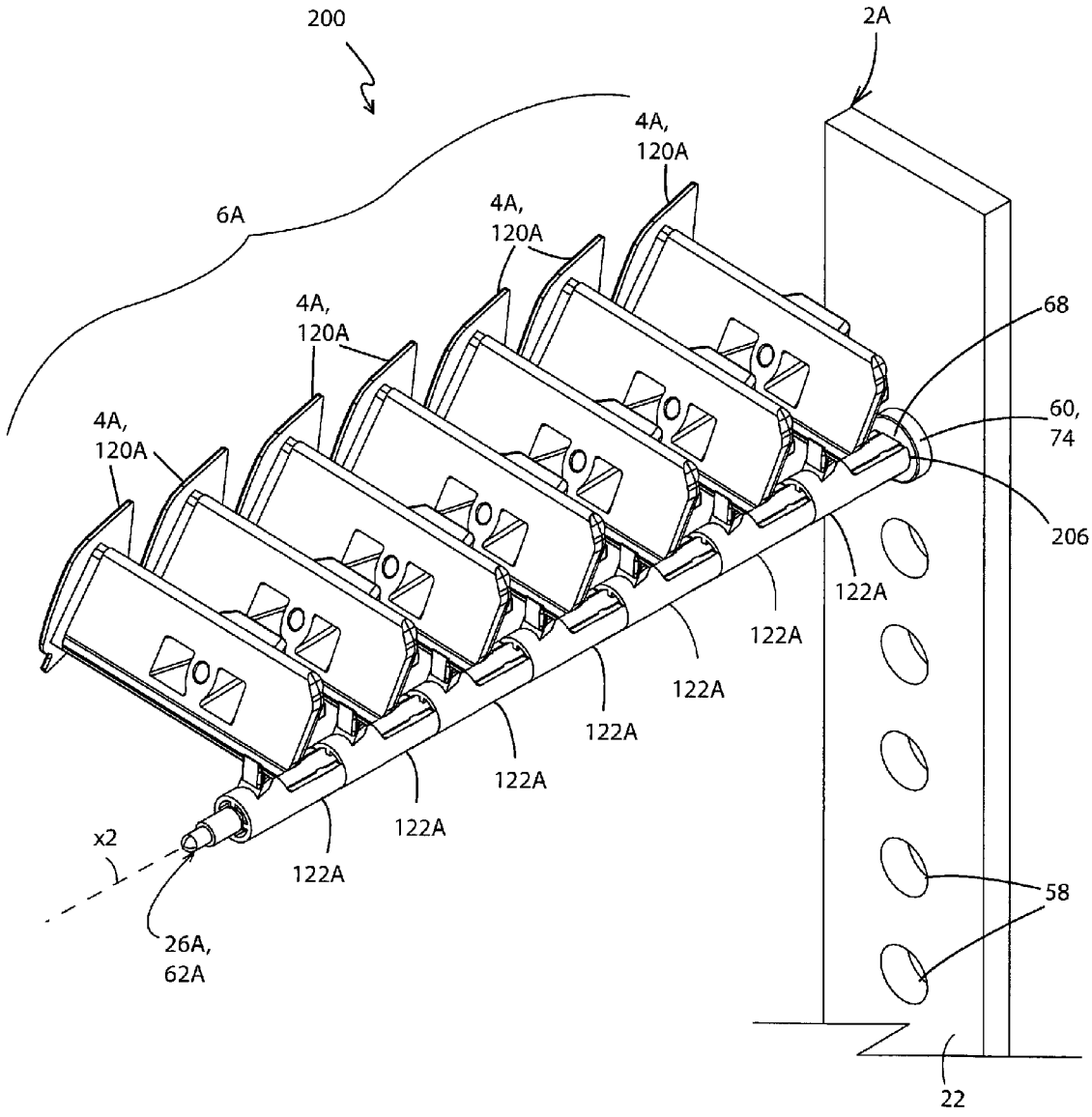
FIG. 15 is an enlarged perspective view similar to FIG. 10 showing a second embodiment of the skewer assembly of the present invention mounted on the rack frame of FIG. 1 and an assembly of a second embodiment of abutting molded pieces mounted on the second embodiment of the skewer assembly.
Figure 26:
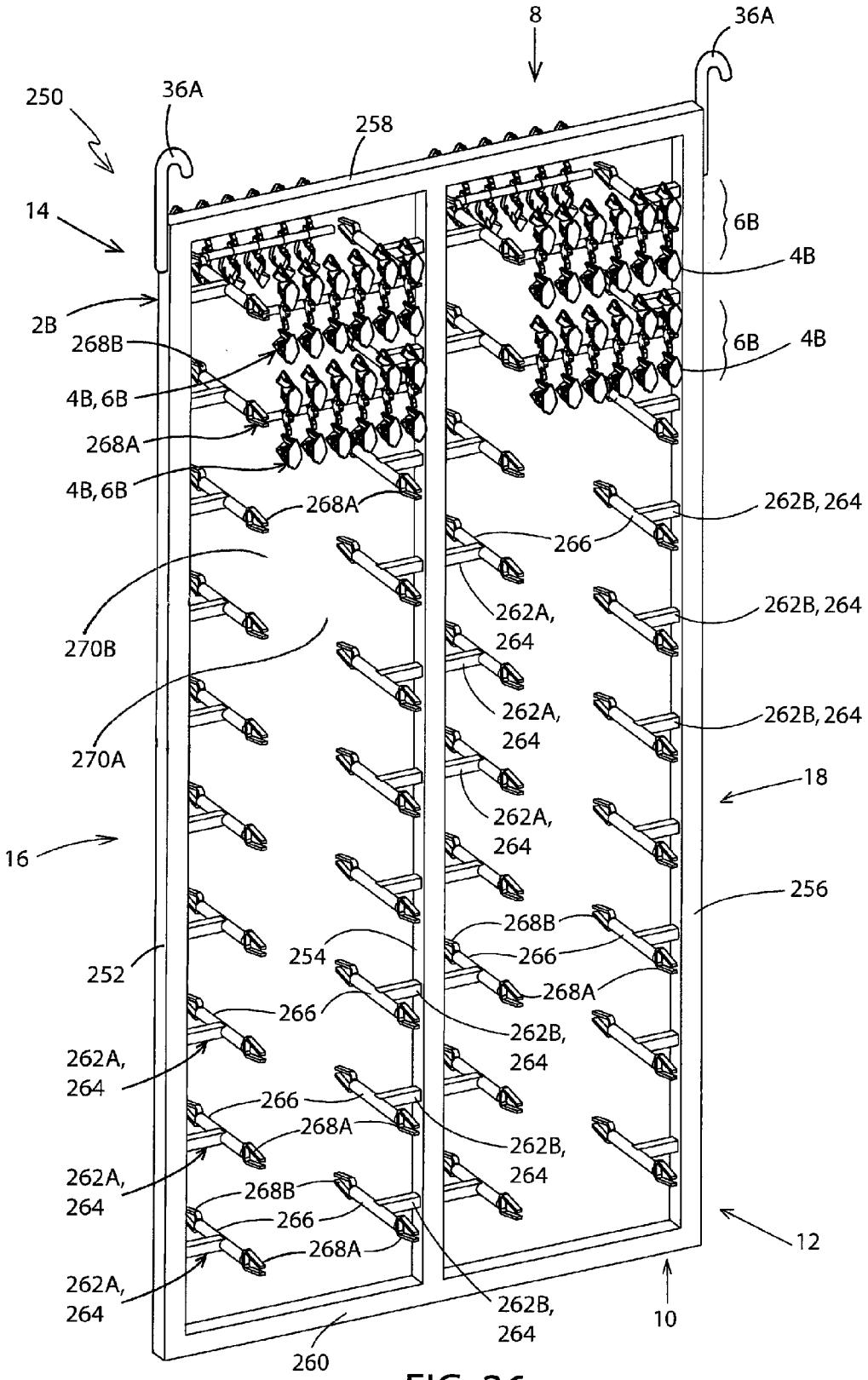
FIG. 26 is a perspective view of a third embodiment of the electroplating rack of the present invention as seen from the front, left and above with several concatenated assemblies of a third embodiment of molded pieces mounted on the upper section of the rack.

A first embodiment of the electroplating system of the present invention is shown generally at 1 in FIG. 1; a second embodiment is shown at 200 in FIG. 15; and a third embodiment is shown at 250 in FIG. 26. Each of these systems includes an electroplating rack and specially molded plastic pieces which are mountable on the rack for electroplating thereof. In particular, system 1 includes an electroplating rack 2 and identical molded plastic pieces 4 which are mounted in groups or assemblies 6 on rack 2 such that each piece 4 of a given assembly 6 is in contact with one or two other pieces 4 of the given assembly. System 1 and rack 2 have a top 8, a bottom 10, a front and back 12 and 14 defining therebetween an axial direction, and left and right sides 16 and 18 defining therebetween a longitudinal direction. System 1 includes a rigid electrically conductive frame 20 which in the exemplary embodiment has a generally parallelepiped configuration. In the exemplary embodiment, frame 20 is formed by various electrically conductive rigid metal frame members or bars most of which are either vertical, axial or longitudinal members. These frame members include substantially identical front and rear vertical bars or uprights 22 and 24 which are approximately midway between left and right sides 16 and 18, with front upright 22 directly in front of rear upright 24.

Multiple skewer assemblies 26 are cantilevered from uprights 22 and 24 and support thereon various molded plastic pieces 4. More particularly, each skewer assembly 26 supports or carries one of assemblies 6 of pieces 4 when the pieces are mounted thereon for electroplating. Many of the skewer assemblies 26 are not shown in FIG. 1 for simplicity. More particularly, FIG. 1 shows 23 left front skewer assemblies 26 which are cantilevered from the left side of front upright 22 and extend longitudinally to the left therefrom. Only the two uppermost left front skewer assemblies 26 have mounted thereon assemblies 6 of pieces 4 in FIG. 1. FIG. 1 also shows 23 right front skewer assemblies 26 which are cantilevered from the right side of front upright 22 and extend longitudinally to the right therefrom although the nuts (detailed below) of assemblies 26 are not shown on the right front skewer assemblies. Only a few of the left rear and right rear skewer assemblies 26 are shown in FIG. 1, which respectively are cantilevered from the left and right sides of rear upright 24 in the same fashion as the left and right front skewer assemblies are from front upright 22. Typically, rack 2 includes a full array of skewer assemblies 26, which in the exemplary embodiment includes 23 left rear skewer assemblies and 23 right rear skewer assemblies mounted on the rear upright 24 along with those mounted on front upright 22. In the exemplary embodiment, the front left and right skewers 26 lie along a common vertical axially extending plane which cuts through the middle of front upright 22. Thus, the left front skewers 26 are vertically aligned so that all of the left front skewers other than the uppermost left right skewer assembly are directly below the uppermost left front skewer assembly 26. The right front skewer assemblies 26 are similarly vertically aligned, as are the left rear skewer assemblies and the right rear skewer assemblies. FIG. 1 also shows that the left front skewer assemblies and the right front skewer assemblies alternate vertically whereby the uppermost left skewer assembly is the highest of all the front skewer assemblies, followed by the uppermost right skewer assembly which is the next highest, then the next left skewer assembly which is the next highest, followed by the next right skewer assembly and so forth. The rear skewer assemblies mounted on rear upright 24 are arranged in the same fashion as those mounted on front upright 22.

The electrically conductive bars of frame 20 further include front and rear top longitudinal bars 28A and 28B which extend from adjacent left side 16 to adjacent right side 18 and a pair of top intermediate axial bars 30 which extend perpendicularly between and are rigidly secured to front and rear bars 28A and B. A front axial bar 32 is rigidly secured to the front of front bar 28A and extends forward therefrom to a rigid connection with the top of upright 22, which extends downward therefrom. Likewise, a top rear axial bar 34 is rigidly secured to the rear of rear longitudinal bar 28B and extends rearwardly therefrom to a rigid connection with the upper end of rear upright 24, which extends vertically downward therefrom. A pair of rigid longitudinally spaced hooks 36 are respectively rigidly secured at their bottom ends to the left and right ends of longitudinal bars 28 and extend upwardly therefrom. Adjacent bottom 10, frame 20 further includes front and rear bottom longitudinal bars 38A and B and an intermediate axial bar 40 which is rigidly secured to and extend between bars 38A and 38B about midway between left and right sides 16 and 18. Frame 20 further includes left and right top axial bars 42A and B, left and right bottom axial bars 44A and B, left and right front uprights 46A and B, and left and right rear uprights 48A and B. The horizontal left top axial bar 42A is rigidly secured to the bottom of hook 36 adjacent the left ends of bars 28A and B and extends forward and rearward therefrom. Horizontal right top axial bar 42B is likewise secured to the right hook 36 adjacent the right end of bars 28 and extends forward and rearward therefrom. Horizontal left bottom axial bar 44A is secured to the left ends of bars 38A and 38B and extends forward from bar 38A and rearward from bar 38B. Horizontal right bottom axial bar 44B is rigidly secured to the right ends of bars 38A and B and extends forward from bar 38A and rearward from bar 38B. Left front vertical bar or upright 46A is rigidly secured at its top end to the front end of left top bar 42A and rigidly secured at its bottom end to the front end of bar 44A. Right front vertical bar or upright 46B at its top end is rigidly secured to the front of bar 42B and rigidly secured at its bottom end to the front end of bar 44B. Left rear vertical bar or upright 48A is rigidly secured at its top end to the rear end of bar 42A and at its bottom end to the rear end of bottom bar 44A. Right rear vertical bar or upright 48A is rigidly secured at its top end to the rear end of bar 42B and at its bottom end to the rear end of bottom bar 44B. All of the members, bars, uprights and hooks in this paragraph are rigid electrically conductive metal members.

The left top and bottom axial bars 42A and 44A, and the left front and rear vertical bars 46A and 48A form an open left rectangle which lies along an axial vertical plane and defines left side 16. The left segments of bottom longitudinal bars 38A and 38B are longitudinally longer than the left skewers 26 extending outwardly to the left from uprights 22 and 24 whereby the bars of this left rectangle are spaced to the left of the left free ends of the left skewers 26. The bars of this left rectangle define a left side rectangular opening 50 which extends along left side 16 from adjacent front 12 to adjacent back 14 and from adjacent bottom 10 to adjacent the top of uprights 46A and 48A. More particularly, opening 50 is completely open between and defined by the bottom of top left axial bar 42A, the top of bottom left axial bar 44A, the back of left front upright 46A and the front of rear left upright 48A. Top bar 42A is higher than the uppermost left skewers 26, bottom bar 44A is lower than the lowermost left skewers 26, front upright 46A is forward of all skewers 26 and rear upright 48A is rearward of all skewers 26. Thus, opening 50 extends from above all of the skewers 26 to below all of the skewers 26 and from forward of all skewers 26 to rearward of all of skewers 26.

The right top and bottom axial bars 42B and 44B, and the right front and rear vertical bars 46B and 48B form an open right rectangle which lies along an axial vertical plane and defines right side 18. The right segments of bottom longitudinal bars 38A and 38B are longitudinally longer than the right skewers 26 extending outwardly to the right from uprights 22 and 24 whereby the bars of this right rectangle are spaced to the right of the right free ends of the right skewers 26. The bars of this right rectangle define a right side rectangular opening 52 which extends along right side 18 from adjacent front 12 to adjacent back 14 and from adjacent bottom 10 to adjacent the top of uprights 46B and 48B. More particularly, opening 52 is completely open between and defined by the bottom of top right axial bar 42B, the top of bottom right axial bar 44B, the back of right front upright 46B and the front of rear right upright 48B. Top bar 42B is higher than the uppermost right skewers 26, bottom bar 44B is lower than the lowermost right skewers 26, front upright 46B is forward of all skewers 26 and rear upright 48B is rearward of all skewers 26. Thus, opening 52 extends from above all of the skewers 26 to below all of the skewers 26 and from forward of all skewers 26 to rearward of all of skewers 26.

Left and right front uprights 46A and 46B define therebetween a front rectangular opening 54 which extends from adjacent left side 16 to adjacent right side 18 and from adjacent bottom 10 to adjacent the top of uprights 46. More particularly, front opening 54 extends from the right side of left upright 46A to the left side of right upright 46B and from the bottom of uprights 46 to the top of uprights 46. Thus, opening 54 extends from below all of skewers 26 to above all of skewers 26 and from the left of all of skewers 26 to the right of all skewers 26. Opening 54 extends further to the left than do the left free ends of the left skewers 26 and further to the right than do the right free ends of the right skewers 26. Opening 54 is not bounded at the top or bottom by a horizontal bar analogous to bars 42 and 44 of the left and right sides. Thus, opening 54 opens upwardly at the top and downwardly at the bottom.

Left and right rear uprights 48A and 48B define therebetween a rear rectangular opening 56 which extends from adjacent left side 16 to adjacent right side 18 and from adjacent bottom 10 to adjacent the top of uprights 48. More particularly, rear opening 56 extends from the right side of left upright 48A to the left side of right upright 48B and from the bottom of uprights 48 to the top of uprights 48. Thus, opening 56 extends from below all of skewers 26 to above all of skewers 26 and from the left of all of skewers 26 to the right of all skewers 26. Opening 56 extends further to the left than do the left free ends of the left skewers 26 and further to the right than do the right free ends of the right skewers 26. Opening 56 is not bounded at the top or bottom by a horizontal bar analogous to bars 42 and 44 of the left and right sides. Thus, opening 56 opens upwardly at the top and downwardly at the bottom.

The left and right rectangular structures of frame 20 which are respectively to the left and right of skewers 26 thus provide structures which protect against damage to skewers 26 during the plating operation while also allowing access to the skewers for the loading and unloading of parts or pieces 4 thereon. More particularly, the bars of the left rectangle, especially uprights 46A and 48A and bottom bar 44A help prevent skewers 26 and pieces 4 from being contacted inadvertently by external objects, such as the walls of the tanks which contain various liquid baths in which the racks are immersed. More particularly, if rack 2 is moved to the left into the wall of such a tank or other object, typically bars 44A, 46A and/or 48A will bump into the wall or object and thus prevent contact between the left skewers 26 or left assemblies 6 and the wall or object. The analogous bars of the right rectangle serve the same purpose with the racks moving to the right. Similarly, the front uprights 46A and 46B serve as bumpers to protect the front skewers and pieces 4 from damage during forward movement of the rack while the rear uprights 48A and 48B similarly protect the rear skewers 26 and parts 4 during rearward movement of rack 2. Pieces 4 are typically manually loaded onto skewers 6 whereby left rectangular opening 50 serves as a left entrance opening through which pieces 4 may be inserted and removed manually or otherwise. Right rectangular opening 52 is likewise a right entrance opening which allows for the same advantages from the right side of rack 2. Openings 54 and 56 also provide manual access respectively to the front and rear skewers 26 and the pieces 4 mounted thereon for any necessary manipulation thereof.

Figure 2:
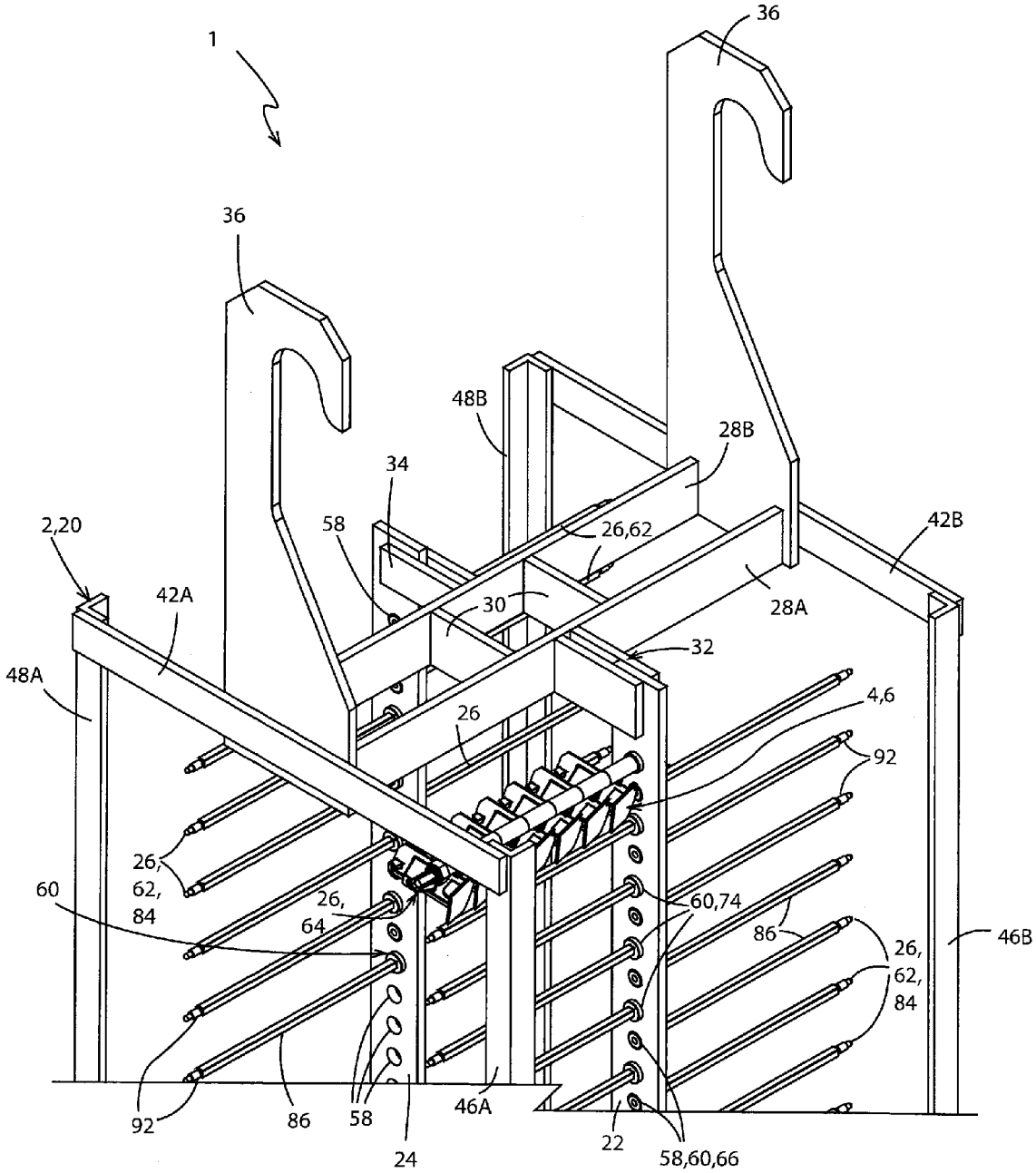
FIG. 2 is an enlarged perspective view of the upper portion of the rack of FIG. 1 showing only one assembly of pieces on the upper left skewer assembly.
Figure 3:
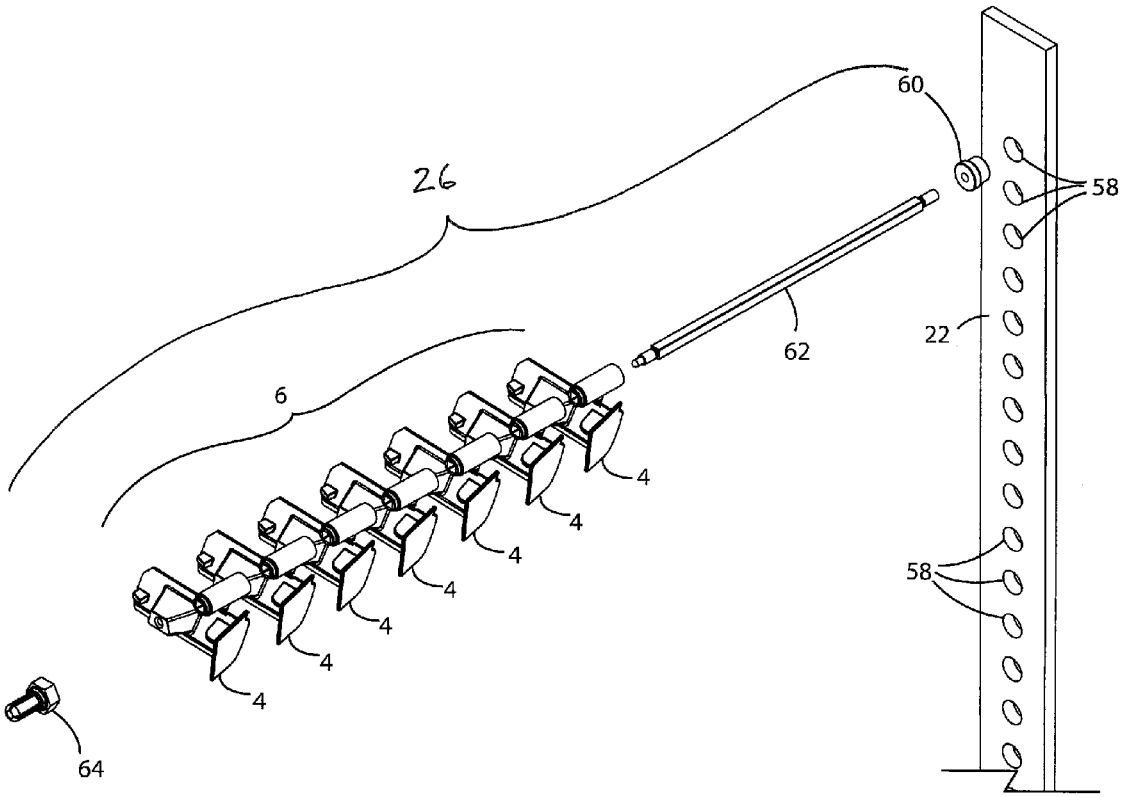
FIG. 3 is an exploded perspective view of the upper left skewer assembly, the molded pieces which formed the assembly of pieces shown in FIG. 2, and an upper portion of the front skewer mounting bar of the rack frame.

As shown in FIGS. 1-3, multiple through holes 58 are formed in each of uprights 22 and 24 extending from their respective left sides to their respective right sides. Holes may be threaded or non-threaded. Each of holes 58 is used for mounting a respective skewer assembly 26 on upright 22 or 24. More particularly, holes 58 are vertically spaced from one another and vertically aligned such that the holes 58 in upright 22 lie along a common vertical line and the holes 58 in upright 24 likewise lie along another common vertical line. The holes 58 in each upright are vertically evenly spaced whereby the centers of each adjacent pair of holes 58 defines therebetween a vertical distance which is the same as that defined by the centers of any other adjacent pair of holes 58 in a given upright. As previously noted, the left and right skewers 26 on a given upright are alternated whereby the left skewers 26 are mounted in every other hole 58 along the left side of the upright and the right skewers 26 are mounted in every other hole along the right side of the given upright. Thus, the longitudinal axis of each adjacent pair of left skewers 26 mounted on a given upright define therebetween a vertical distance which is twice that of the vertical distance defined between the centers of each adjacent pair of holes 58. This is likewise true of the right skewers 26 on a given upright. This configuration of the skewers facilitates the ability to mount a relatively large number of pieces 4 on a given rack.

Figure 11:
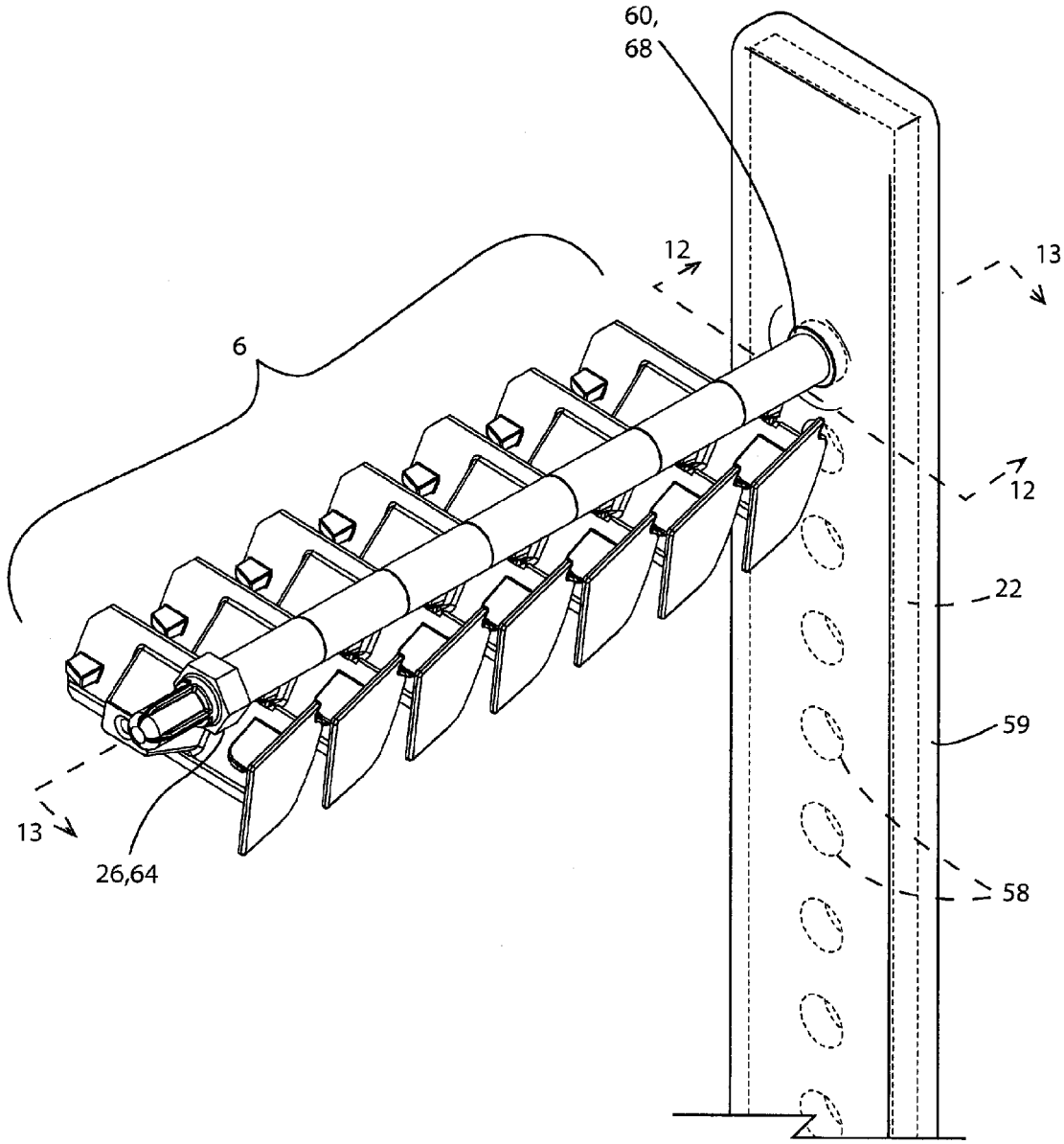
FIG. 11 is similar to FIG. 10 and shows the skewer supporting bar of the rack frame encased in the outer coating of the rack.
Figure 12:
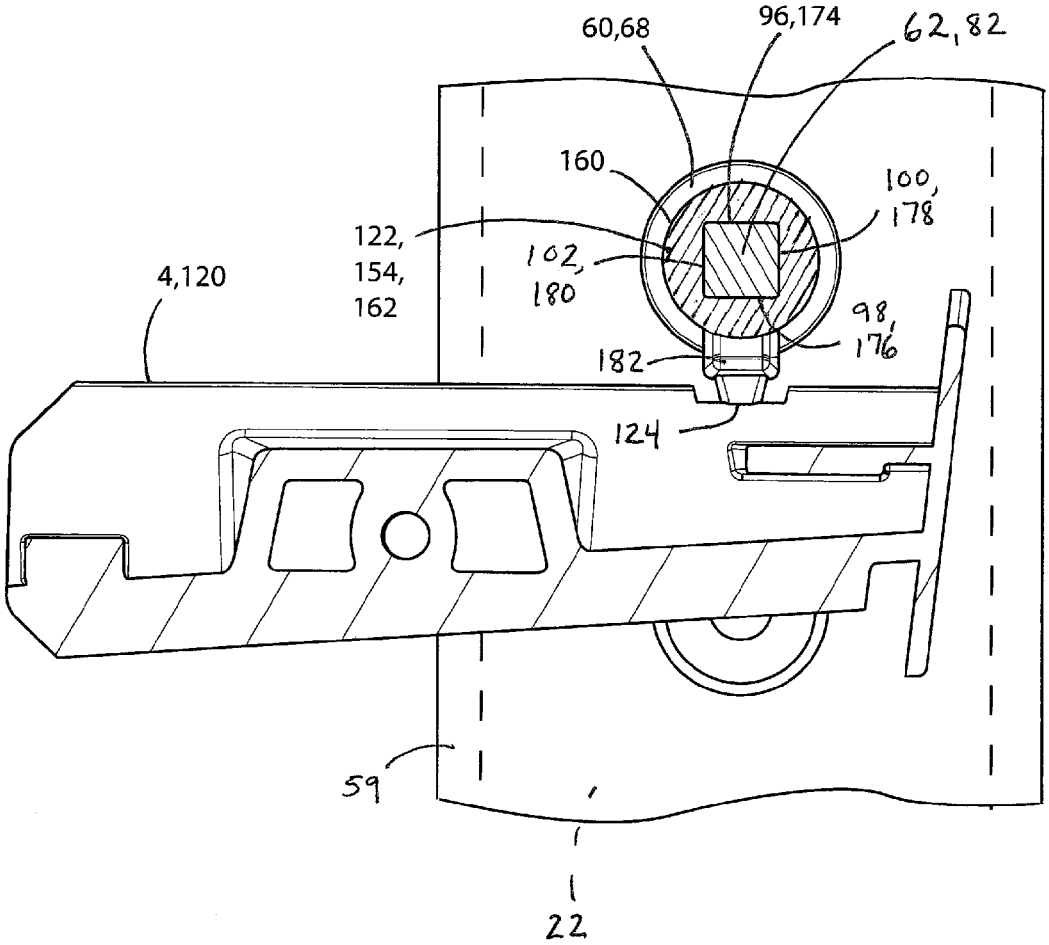
FIG. 12 is an enlarged sectional view taken on line 12-12 of FIG. 11.

Although not shown in FIG. 1, all of the electrically conductive members of rack 2 which are to be immersed in the liquid baths during the electroplating process are coated with an outer layer or coating 59 (FIGS. 11-13) of electrically non-conductive or dielectric plastic material such as Plastisol® with the exception of skewer assemblies 26 and at least the upper portions of hooks 36. Thus, uprights 22, 24, 46 and 48, longitudinal bars 28 and 38, and axial bars 30, 32, 34 and 40, and the lower portions of hooks 36 are fully encased in coating 59. The relationship between outer coating 59 and skewer assemblies 26 is described further below.

Skewer assembly 26 is now described in greater detail with primary reference to FIGS. 3-6. As shown in FIG. 3, each assembly 26 includes a rigid electrically conductive skewer mounting member 60 in the form of a metal bushing, a straight longitudinally elongated electrically conductive metal rod or skewer 62, and a piece-retaining or piece-securing member 64 in the form of an electrically non-conductive or dielectric nut typically formed of a plastic material. Securing member 64 is removably mountable on skewer 62.

Figure 4:
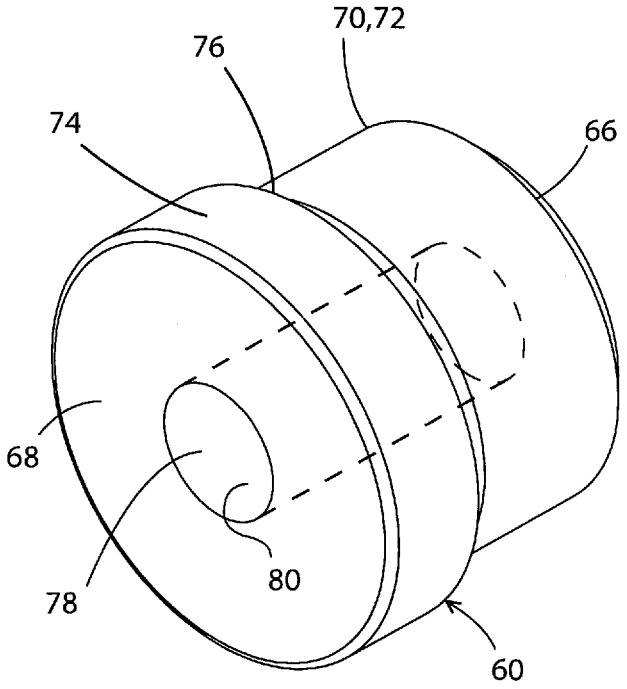
FIG. 4 is an enlarged perspective view of the skewer mounting member or bushing shown in FIG. 3.
Figure 10:
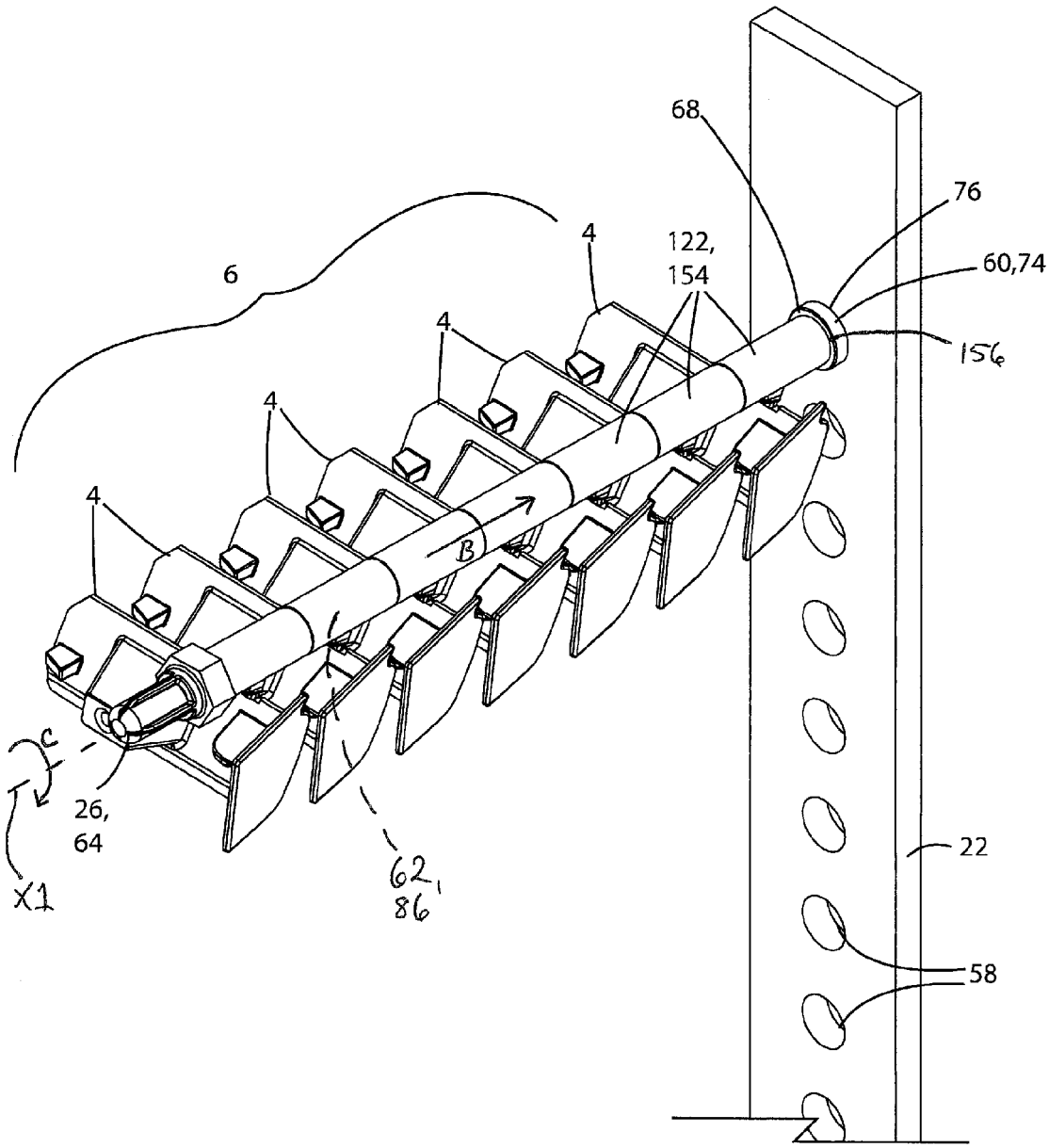
FIG. 10 is an enlarged perspective view of the concatenated assembly of FIG. 9 mounted on the upper left skewer assembly of the first embodiment of the electroplating rack.
Figure 13:
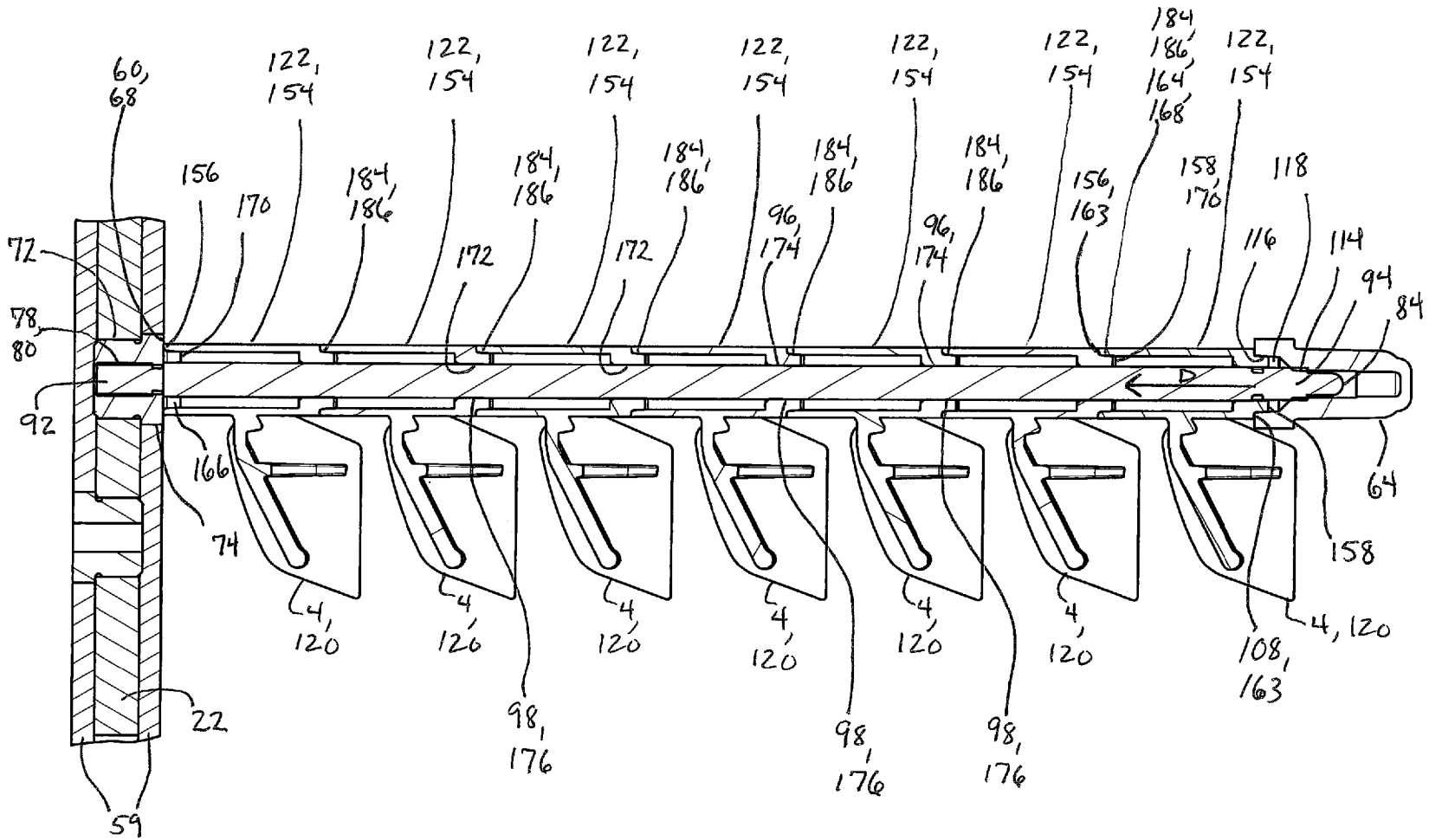
FIG. 13 is a sectional view taken on line 13-13 of FIG. 11.

With primary reference to FIG. 4, mounting member 60 has parallel circular annular inner and outer ends 66 and 68 which are substantially flat and vertical in the mounted configuration. Bushing 60 has a circular or generally cylindrical outer surface 70 that includes a narrower or smaller diameter inner section 72 and a wider or larger diameter outer section 74 which steps radially inwardly to inner section 72 at a circular annular shoulder 76 which faces inner end 66. Member 60 has a cylindrical inner surface 78 which defines a cylindrical central through hole 80 extending from inner end 66 to outer end 68. Inner surface 78 is concentric with outer surface 70. Outer surface 70 of inner section 72 may be externally threaded and screwed into a threaded hole 58 of one of uprights 22 or 24 to rigidly secure member 60 to the upright in electrical contact therewith (FIGS. 10, 13). Alternately, section 72 may simply be inserted into a non-threaded hole 58 and welded or otherwise secured to the upright. When member 60 is mounted on the upright, shoulder 76 abuts the outer surface of the upright, outer section 74 extends radially outwardly beyond hole 58 and longitudinally outwardly from the outer surface of the upright so that vertical outer end 68 is spaced outwardly a short distance from the upright vertical outer surface. When coating 59 is applied to the metal members of rack 2 including the uprights, the outer surface of coating 59 is substantially flush with outer surface 68 whereby typically only outer surface 68 of member 60 is exposed.

Figure 5:
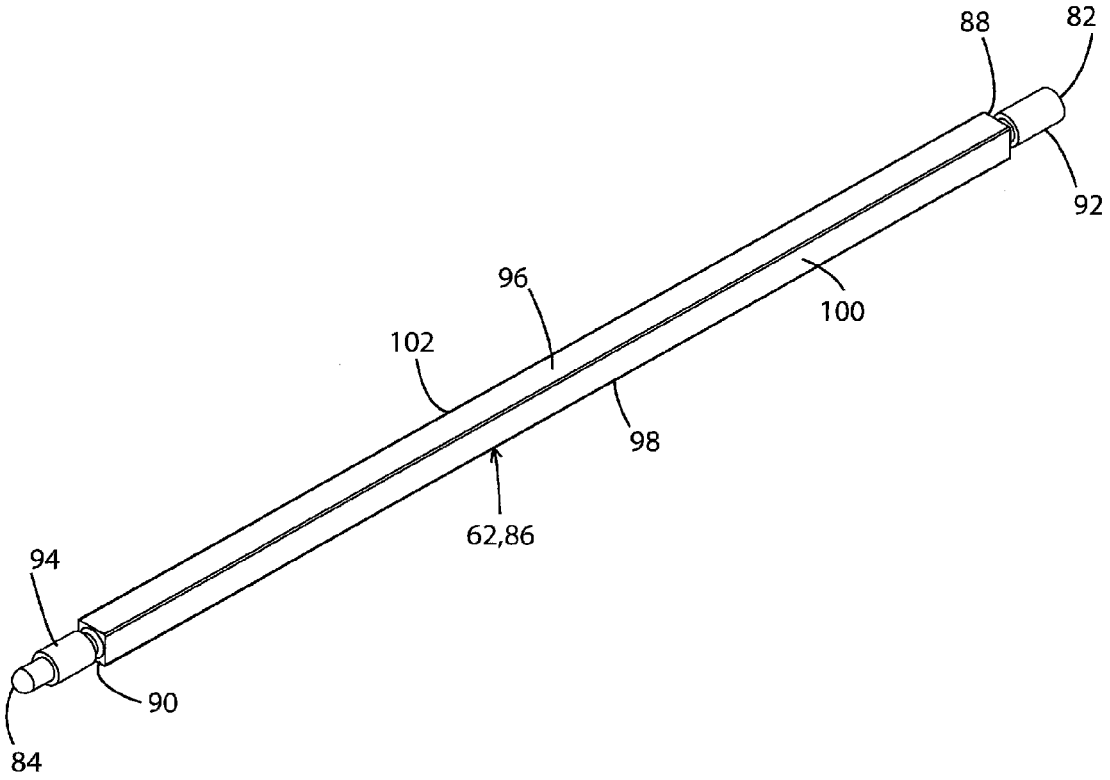
FIG. 5 is an enlarged perspective view of the skewer of the skewer assembly shown in FIG. 3.

With primary reference to FIG. 5, skewer 62 has an inner mounting end 82 and an outer free end 84 between which skewer 62 is longitudinally elongated. Skewer 62 includes a main or piece-carrying shaft 86 which has a square or other non-circular cross-section. Shaft 86 has an inner end 88 which is adjacent inner end 82 and an outer end 90 which is adjacent outer free end 84. Skewer 62 includes a relatively short inner end mounting segment 92 which extends from inner end 82 to adjacent inner end 88. Skewer 62 further includes an externally threaded outer end retaining member segment 94 which is also relatively short and extends from end 84 to adjacent end 90. Shaft 86 has a top flat surface 96, a bottom flat surface 98 parallel to top surface 96, a front flat surface 100 and a rear flat surface 102 parallel to surface 100. Surfaces 100 and 102 are perpendicular to surfaces 96 and 98. Surfaces 96-102 form the longitudinally elongated straight or flat sides of the square cross-section of shaft 86 and intersect at respective four longitudinally elongated straight corners thereof. Each of surfaces 96-102 is flat and straight in a continuous manner from end 88 to end 90. Inasmuch as skewer 62 is formed of an electrically conductive metal, its entire outer surface is electrically conductive. Inner mounting segment 92 may be externally threaded in combination with a threaded hole 80 of mounting member 60 to provide a threaded connection therebetween for rigidly mounting skewer 62 on mounting member 60 with electrical contact therebetween. Alternately, segment 92 may be non-threaded and simply inserted into hole 80 and welded or otherwise rigidly secured thereto (FIGS. 10, 13). When skewer 62 is mounted on member 60, inner end 88 is closely adjacent or in contact with outer surface 68. Inner ends 82 and 88 and segment 92 are adjacent the upright 22, 24 on which assembly 26 is mounted while outer ends 84 and 90 and segment 94 are distal the upright 22, 24 on which assembly 26 is mounted. The various electrically conductive members of rack 2 thus provide an electrical pathway for conducting an electrical current from hooks 36 to skewers 62 and thus to pieces 4 when mounted on skewers 62.

Figure 6:
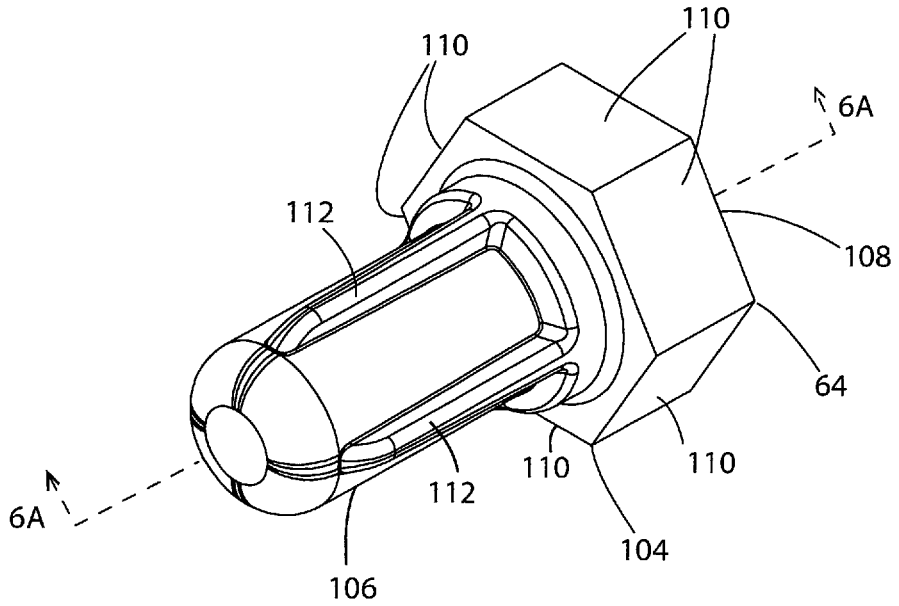
FIG. 6 is an enlarged perspective view of the nut or molded piece securing member of the skewer assembly of FIG. 3.
Figure 6A:
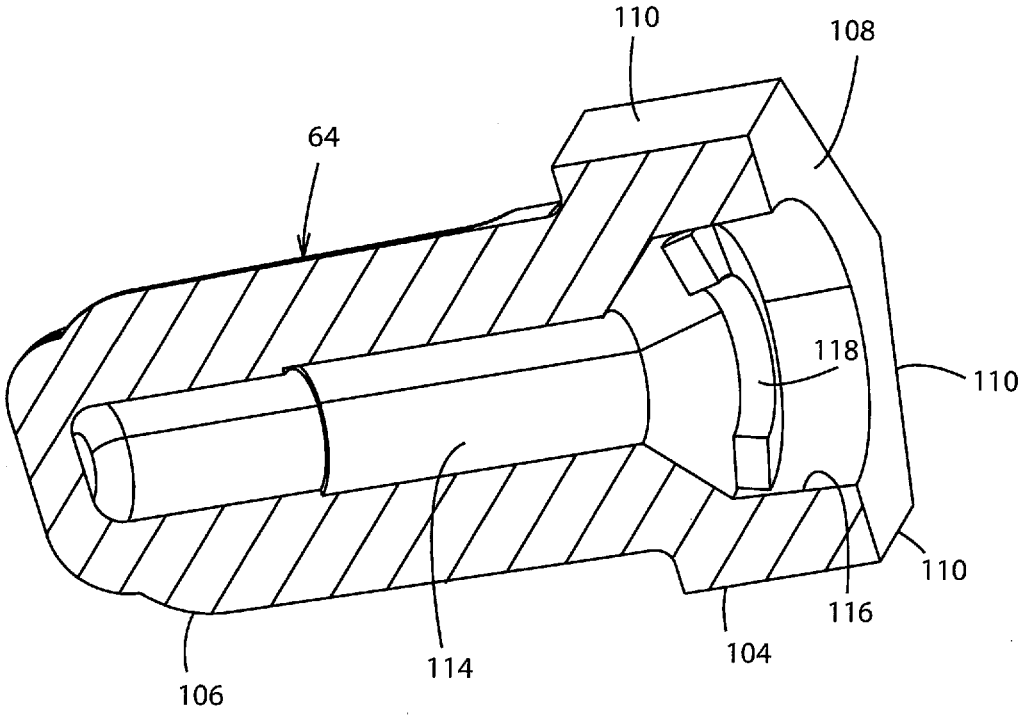

With primary reference to FIGS. 6 and 6A, nut 64 includes an inner section 104 and an outer section 106. Nut 64 has an inner end 108 defined by inner section 104. Inner section 104 in the exemplary embodiment has a hexagonal shape and thus includes six flats 110 which are engagable by a wrench or the like. Outer section 106 is generally cylindrical and includes a plurality of longitudinally elongated finger tabs or ribs 110 extending outwardly from the cylindrical outer surface of section 106 whereby ribs 112 are manually engagable to facilitate screwing or unscrewing the nut 64 onto or off of the externally threaded outer end retaining member segment 94 of skewer 62. Nut 64 defines an internally threaded hole 114 configured to threadedly engage externally threaded segment 94 of skewer 62. Hole 114 is open or has an entrance opening at end 108 but is closed at its opposite end whereby hole 114 is typically not a through hole. Nut 64 further defines a washer-receiving recess 116 which extends radially outwardly from hole 114 in a counterbore fashion such that recess 116 extends inwardly from end 108 and receives therein a spring member in the form of a spring washer 118.

Figure 7:
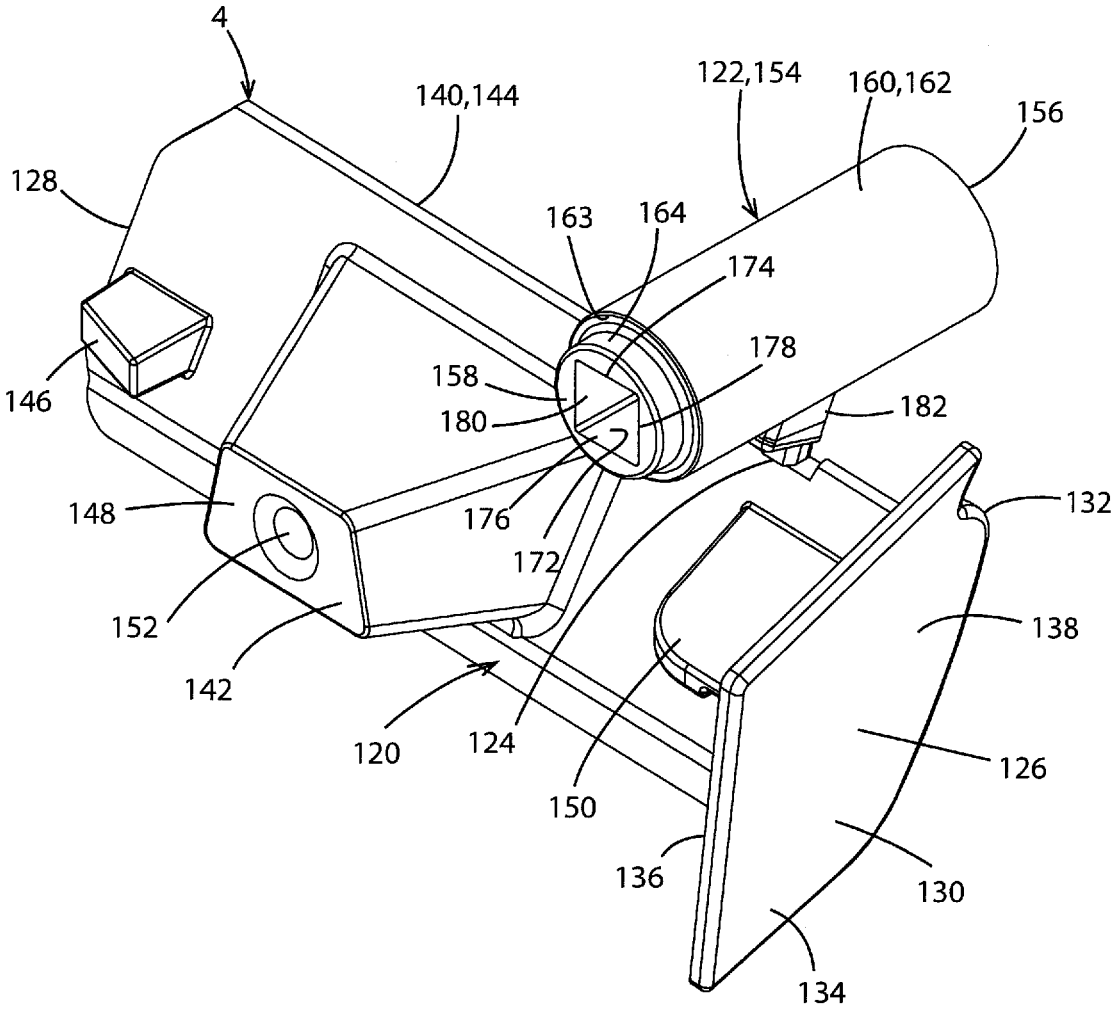
FIG. 7 is an enlarged perspective view of the molded piece shown in FIGS. 1-3 as viewed from the front, left and above.
Figure 8:
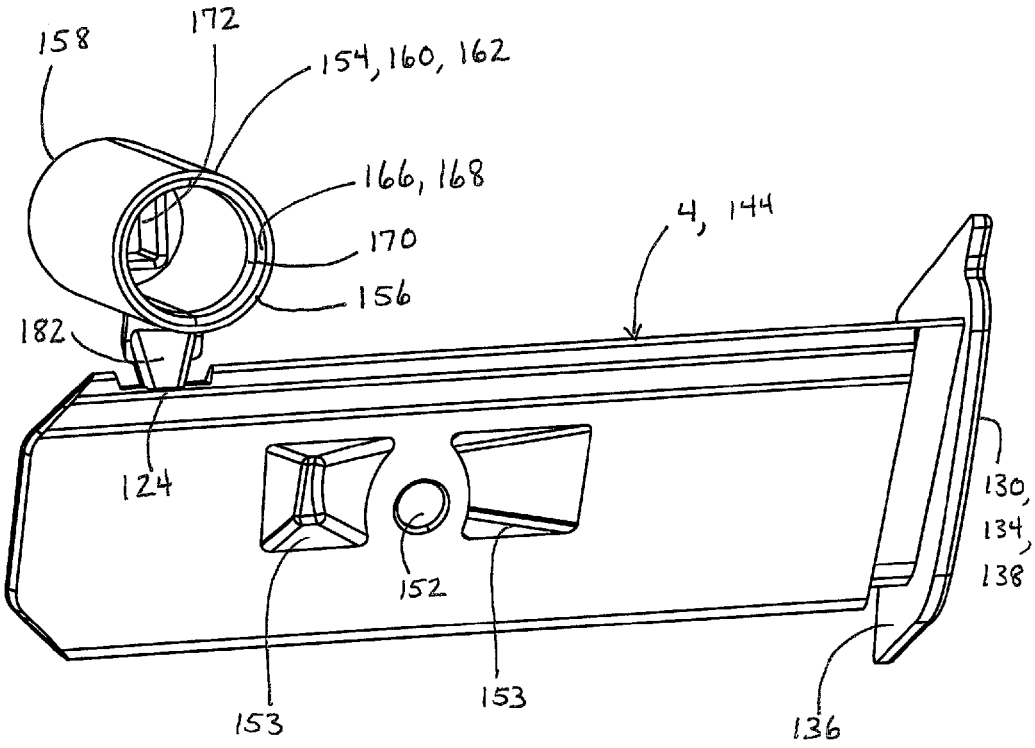
FIG. 8 is an enlarged perspective view of the molded piece shown in FIG. 7 as viewed from the rear.

With primary reference to FIGS. 7 and 8, molded plastic piece 4 is described in greater detail. Piece 4 includes a final-shape part 120 and a mounting or joining part 122 which is secured to part 120 at a sever zone or fracture zone 124 which is a relatively thin, narrow or small structure at the intersection between parts 120 and 122 which may be broken, cut or otherwise severed with relative ease by hand although it is sufficiently strong to allow for the handling of piece 4 without breakage during the loading and unloading of pieces 4 on skewer assemblies 26 and during the electroplating process. Final-shape part 120 may be of any desired configuration and is shown here as a typical automotive part. Part 120 has first and second opposed ends 126 and 128 with a substantially flat plate or decorative portion 130 adjacent first end 126. Plate 130 has a contoured outer perimeter 132 which includes straight edges and curved edges as well. Plate 30 has a first side 134 which defines end 126 and a second opposed side 136 facing away from first side 134. Part 120 has an essential or Class A plating surface 138 which in the exemplary embodiment includes the entire first side 134 and contoured outer perimeter 132. For certain purposes, this surface 138 is the surface which is required to be uniformly fully electroplated and free from aesthetic defects as a result of the electroplating process. Part 120 further includes a non-decorative portion 140 which may also be referred to as a remainder of the body of part 120. Non-decorative portion 140 has a non-essential outer surface 142 which may also be referred to as a potential plating surface which may be electroplated or not during the electroplating process. Surface 142 includes all of the exposed surfaces which may come into contact with the liquid baths of the electroplating process other than the essential plating surface 138. Thus, in many cases, it is not important whether non-essential surface 142 is electroplated or not to the end user. Typically, non-essential surface 142 is structurally important, but is in its end use also hidden from view in contrast to plating surface 138, which is in view of the end user to provide aesthetic appeal.

As previously noted, the configuration of a given part 120 can vary infinitely, and may present a relatively complex configuration. For the purposes of the present invention, it is simply noted that non-decorative portion 140 includes a first section 144, a second section 146 which projects outwardly from section 144, a third section 148 which projects outwardly from section 144, and a fourth section 150 which projects outwardly from section 144 and the second side 136 of plate 130. In the exemplary embodiment, a through hole 152 is formed through section 148, which also defines a pair of recesses 153. This description of non-decorative portion 140 is to emphasize in part the fact that portion 140 may include multiple flat or curved surfaces which are angled relative to one another, as well as define cavities, recesses or holes therein.

With continued reference to FIGS. 7 and 8, mounting or joining part 122 includes a tube or collar 154 which is generally cylindrical and has an annular first inner end 156 and a parallel opposed annular second outer end 158. Collar 154 has a circular outer surface 160 extending from end 156 to end 158. Collar 154 includes a wider or larger diameter main inner section 162 and a narrower or smaller diameter outer end section or insert 164 which steps inwardly from main section 162 at a circular annular outer end or shoulder 163 of main section 162 adjacent end 158. Ends 156 and 163 thus serve as the inner and outer ends of main section 162. Collar 154 defines a circular or cylindrical annular recess 166 extending inwardly from end 156 and defined by a circular annular inner surface 168 which extends inwardly from end 156 to a circular annular end surface or shoulder 170 which faces toward end 156. A square or other non-circular through hole or passage 172 is formed in collar 156 extending from end 158 toward or to shoulder 170, where it communicates with recess 166, which extends radially outwardly from hole 172. Hole 172 is thus defined by a square inner surface including a top flat inner surface 174, a parallel bottom flat inner surface 176, and front and rear flat surfaces 178 and 180 which are parallel to one another and perpendicular to surfaces 174 and 176. Part 122 further includes a neck 182 which is rigidly secured to and extends downwardly and outwardly from outer surface 160 a short distance to fracture zone 124.

Figure 9:
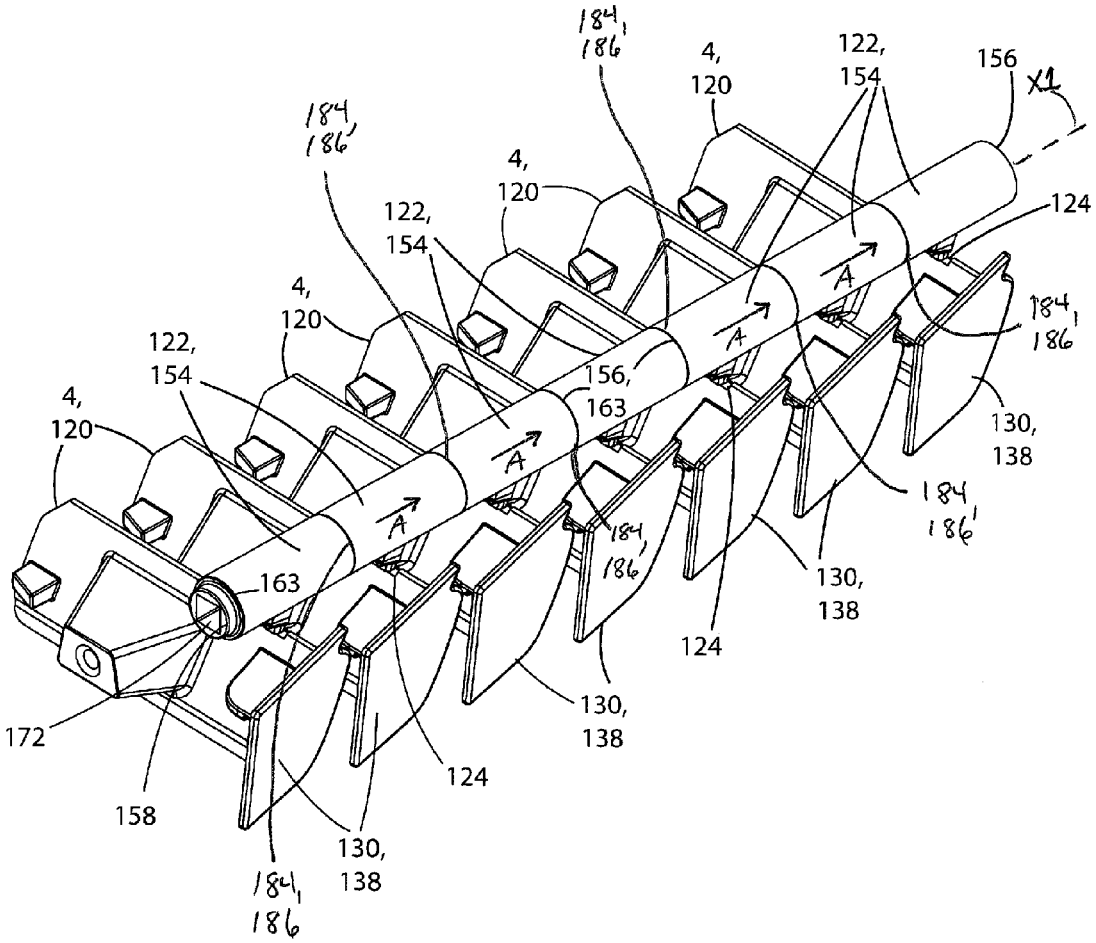
FIG. 9 is an enlarged perspective view of the concatenated assembly of molded pieces shown in FIGS. 1-3.

The assembling or joining of pieces 4 to form assembly 6 is now described with primary reference to FIGS. 3 and 9. FIG. 3 shows pieces 4 in an unjoined position or configuration in which pieces 4 are separate or out of contact with one another whereas FIG. 9 shows the seven pieces 4 in a joined position or configuration in which joining parts 122 are removably joined to one another in an end-to-end manner. The configuration generally indicated by FIG. 3 in which the pieces 4 are separate from one another may also be called a pre-electroplating configuration prior to the assembly thereof whereby pieces 4 are not ready for electroplating in accordance with the concept of the present invention. The joined position of FIG. 9 may be thought of as an electroplating position or configuration of pieces 4 in which assembly 6 is ready to be electroplated once mounted in this configuration on a given skewer assembly 26. In the joined position of FIG. 9, none of the final parts 120 are in contact with any other of the parts 120 of assembly 6. Thus, the collars 154 of the first and last (here seventh) pieces 4 of assembly 6 are each in contact only with one other collar 154 of assembly 6. The collars 154 of the other or interior or intermediate pieces 4 of assembly 6 are each in contact with two other collars 154 of the pieces 4 of assembly 6. Thus, as viewed from the right to left of FIG. 9, the first or innermost collar of the sequentially aligned collars of assembly 6 is in contact only with the second collar 154, and the left or seventh or outermost collar 154 is in contact only with the sixth collar. The intermediate second collar 154 is in contact with and joined to the first and third collars 154, the intermediate third collar 154 is in contact with and joined to the second and fourth collars, the intermediate fourth collar 154 is in contact with and joined to the third and fifth collars, and so forth.

The joining of the various collars 154 to join pieces 4 to one another to form assembly 6 is simply a matter of pushing a given piece with its collar in a linear direction into contact and a joining engagement with another collar as indicated by Arrows A in FIG. 9. Joining two collars requires no more than this single linear movement of one collar relative to another. In the exemplary embodiment, each adjacent pair of collars is joined by a press fit connection or a snap fit connection. The outer diameter of insert 164 is very nearly the same and slightly less than the inner diameter of annular inner surface 168 whereby the two surfaces frictionally engage one another when insert 164 is inserted into recess 166 by the linear movement noted above. This insertion or joining of the two collars forms a joint 184 shown in FIG. 13. Electrically conductive adhesive 186 may be used within joint 184 between surfaces 164 and 168, between surfaces 156 and 163 and between surfaces 158 and 170 if desired to help the collars hold together better and also to provide better electrical conductivity therebetween. Such an adhesive may also provide a better seal between each connected pair of collars which is more leak proof with respect to the liquid solutions used in the electroplating process than without the adhesive. For any given pair of collars which are joined to one another, surfaces 164 and 168 are thus in contact with one another and/or adhesive 186, which is likewise true of surfaces 156 and 163 as well as surfaces 158 and 170. When the pieces are joined to one another, collars 154 are aligned such that the collars and passages 172 thereof have a central longitudinal axis X1 passing through the center passages 172 and the center of collar 154.

The joining of collars 154 may be achieved separate from the mounting of pieces 4 on skewer 62. However, sliding each piece 4 so that its collar 154 slides along parallel to axis X1 (which also represents the central longitudinal axis of skewer 62 in FIG. 10) or slidably receives skewer 62 within passage 172 thereof facilitates the joining process. More particularly, after a first collar 154 is slid onto skewer 62, sliding a second collar 154 along the same skewer 62 automatically aligns the two collars with one another parallel to axis X1 whereby insert 164 of one collar is aligned with the recess 166 of the other collar so that the insertion of insert 164 into recess 166 is simplified. In addition, the mounting of a given collar 154 on skewer 62 prevents a given piece 4 from rotating relative to skewer 62 about axis X1 due to the mating engagement between the square or non-circular shaft 86 and the square or non-circular passage 172 of the given collar. This engagement between the shaft 86 and inner surface defining passage 172 thus provides an anti-rotation mechanism and also helps ensure that the orientation of pieces 4 is the same relative to skewer 62 when mounted thereon, as detailed below. During the insertion of insert 164 into recess 166, there is a linear sliding engagement between surface 164 and surface 168 until joint 184 is formed. A linear sliding movement of pieces 4 along skewer 62 is illustrated in FIG. 10 by Arrow B, which may also represent sliding the whole pre-joined assembly 6 onto skewer 62.

During the sliding mounting of collar 154 on skewer 62, the flat surfaces 174, 176, 178 and 180 respectively slidably engage the flat surfaces 96, 98, 100 and 102 of shaft 86. This sliding engagement occurs between each of pieces 4 and skewer 62. However, this sliding engagement occurs over different distances for each piece 4 of a given assembly 6. For each piece 4, this sliding engagement occurs from or begins at outer end 90 adjacent outer end 84 and continues until the given piece 4 reaches its mounted position on skewer 62. For the first or innermost piece 4, this sliding engagement continues until inner end 156 thereof reaches and abuts outer surface 68 of member 60, which serves as a stop which prevents further inward longitudinal movement of the innermost piece 4. If the first and second pieces 4 are joined to one another prior to mounting on skewer 62, surface 68 also serves as a stop to movement of the second piece 4, which is likewise true of any of the pieces 4 of a given assembly if joined prior to mounting on skewer 62. If the second piece 4 is slid onto skewer 62 after the first piece 4 has already reached its mounted position, the second piece 4 will abut and join to the first piece 4 while on skewer 62, so the second piece 4 stops sliding when the joint between the first and second pieces 4 is formed. This will similarly occur with other pieces 4 of a given assembly 6 when not joined before mounting on skewer 62. In either case, the sliding engagement of each successive piece occurs over a shorter distance such that the sliding engagement between the skewer and the second piece is shorter than that with the first piece, the sliding engagement between the skewer and the third piece is shorter than that with the first and second pieces, the sliding engagement between the skewer and the fourth piece is shorter than that with the first, second and third pieces, and so forth.

In the mounted position of assembly 6, the pieces 4 thereof are mounted sequentially in the longitudinal direction from the innermost to the outermost piece, which in the present embodiment is from the first piece 4 to the seventh piece 4. The pieces 4 are thus sequentially spaced different horizontal longitudinal distances from the inner end of the skewer 62 on which they are mounted and from the upright on which the skewer is mounted. This horizontal longitudinal distance for the second piece 4 is thus greater than for the first piece 4, while it is greater for the third piece 4 than for the first and second pieces, greater for the fourth piece 4 than for the first, second and third pieces, and so forth.

Once assembly 6 is formed, all of pieces 4 are similarly oriented such that all of the analogous components of pieces 4 of assembly 6 are longitudinally aligned with one another. The plates or decorative portions 130 of pieces 4 are aligned and longitudinally adjacent and spaced from one another. Thus, the flat side 134 and majority of plating surface 138 are generally aligned along a common plane and face the same direction. After all seven pieces 4 are slid onto skewer 62 and joined to one another, nut 64 is rotated (Arrow C in FIG. 10) about axis X1 to threadedly engage segment 94 of skewer 62, thereby tightening nut 64 into engagement with outer end 158 of the outermost piece 4 to secure or retain pieces 4 on skewer 62. The tightening of nut 64 thus presses or forces the various collars 154 of the pieces into tight contact with one another such that inner end 156 of the first or innermost collar 154 abuts the outer surface 68 of mounting member 60 as shown in FIGS. 10 and 13. The force applied by nut 64 along the column of collars 154 is indicated at Arrow D in FIG. 13. This likewise represents the direction in which a nut and collars move in response to the tightening rotation of the nut. In the secured position, nut 64 and mounting member 60 thus serve as clamping members which clamp therebetween all of the collars 154 of assembly 6. Where nut 64 includes spring washer 118 or another spring member, it provides the clamping surface of nut 64. In addition, washer 118 provides a longitudinal spring bias parallel to the skewer (in the direction of Arrow D) from adjacent outer end 84 toward inner end 82 on collars 154 to bias collars 154 toward inner end 82 to facilitate keeping joints 184 tight during the electroplating process. The tightening and/or loosening of nut 64 may be achieved by manually engaging ribs 112 and/or with the use of a wrench or other tool on flats 110. When collars 154 are mounted on skewer 62, flat surfaces 174, 176, 178 and 180 are typically respectively in engagement with and fixed with respect to flat surfaces 96, 98, 100 and 102 of shaft 86.

Figure 14:
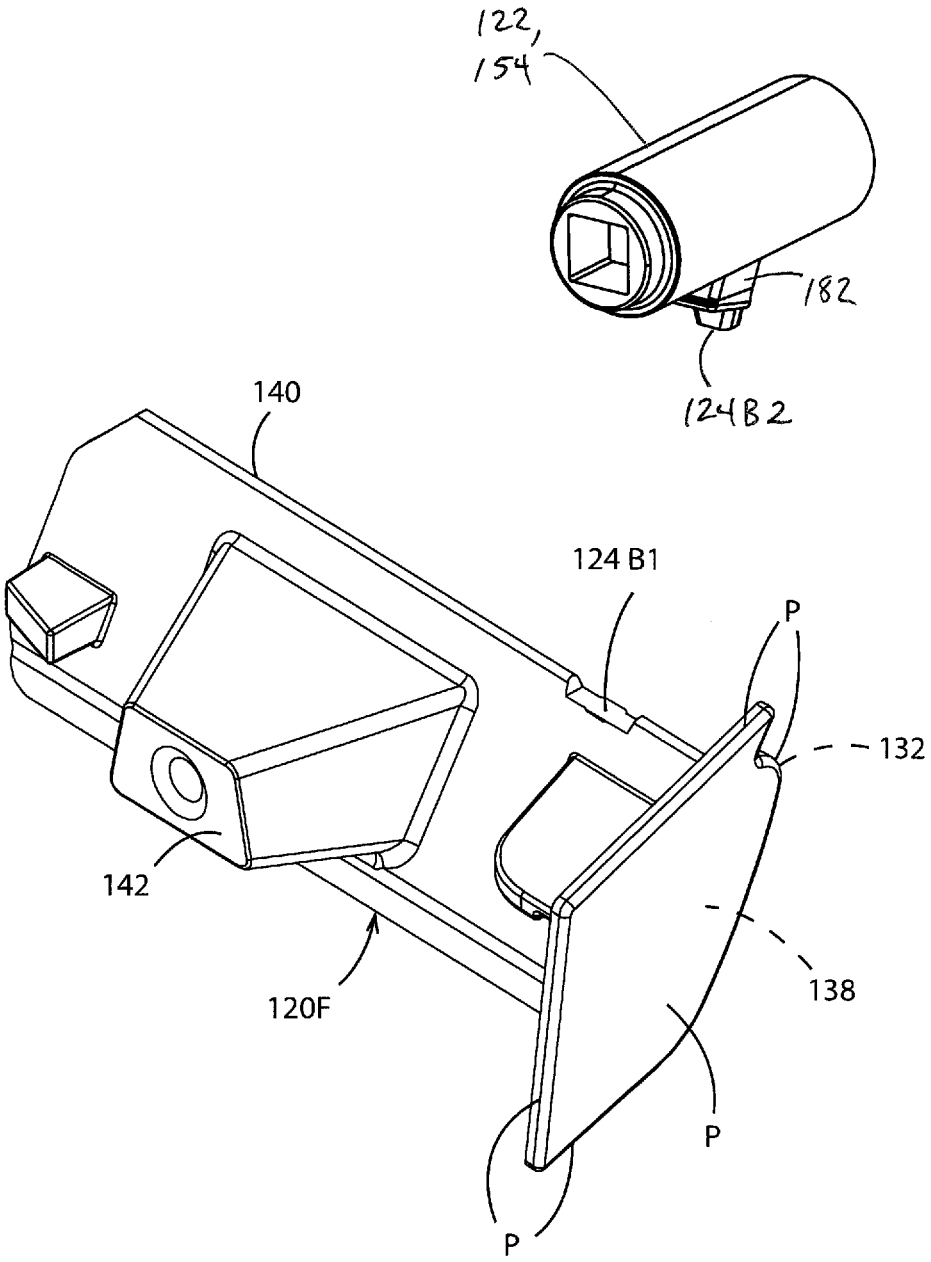
FIG. 14 is a perspective view similar to FIG. 7 showing the finished part of the molded piece broken off and separated from the mounting or joining part of the molded piece.

Once each of the assemblies 6 is mounted on a given skewer to form an electroplating assembly in which each skewer assembly 26 of rack 2 carries an assembly 6, system 1 is ready to begin the electroplating process as generally described in the Background section of the present application and as described further below. After the pieces 4 have been electroplated and with reference to FIG. 14, essential surface 138 is plated with a thin metal layer, coating or plate P which entirely covers surface 138. Various of the other surfaces of part 4 may be electroplated as well as previously discussed although in the exemplary embodiment, these are the non-essential plating surfaces 142. Once the electroplating process is completed, the various nuts 64 will be unthreaded to remove them from the ends of the respective skewer 62 to allow the longitudinally outward sliding removal or unloading of the various pieces from skewer 62, which includes a sliding engagement between the various pieces 4 and skewer 62 analogous to that described during loading of pieces 4 although in the opposite direction. Once the pieces have been removed, parts 120 and 122 are fractured, broken apart, cut or otherwise severed along sever or fracture zone 124 manually or otherwise as indicated at Arrow E in FIG. 14. This provides a finished electroplated part 120F and a mounting or joining part 122 which is broken off and separated from part 120F. This breaking, fracturing or severing process thus produces a broken, fractured or severed surface 124B1 on part 120F and a fractured, broken or severed surface 124B2 on leg 182 of part 122. Finished part 120F is then typically packaged and shipped to the customer for use as desired. Broken off parts 122 are typically scrap parts or material which may be thrown away or recycled. This broken apart configuration shown in FIG. 14 is thus a post-electroplating configuration of piece 4.

Electroplating system 200 is similar to system 1 and includes a rack 2A which utilizes all the structures of rack 2 except that the skewer assemblies 26 of system 1 are replaced with skewer assemblies 26A. Each assembly 26A is configured for use with a group or assembly 6A of identical molded plastic pieces 4A, as shown in FIG. 15. Skewer assemblies 26A are similar to assemblies 26 and include the same mounting member 60. However, assembly 26A eliminates the nut 64 or other separate retaining or securing member used to hold parts 4 on skewer 26 of system 1. Pieces 4A are similar to pieces 4 and include final shape parts 120A and mounting or joining parts 122A which are likewise slidable onto skewer assemblies 26A to form a group or assembly 6A of seven pieces 4A. Pieces 4A when mounted on skewer 26A are positioned such that parts 122A are in end-to-end contact with one another similar to that described with the collars of pieces 4.

Figure 16:
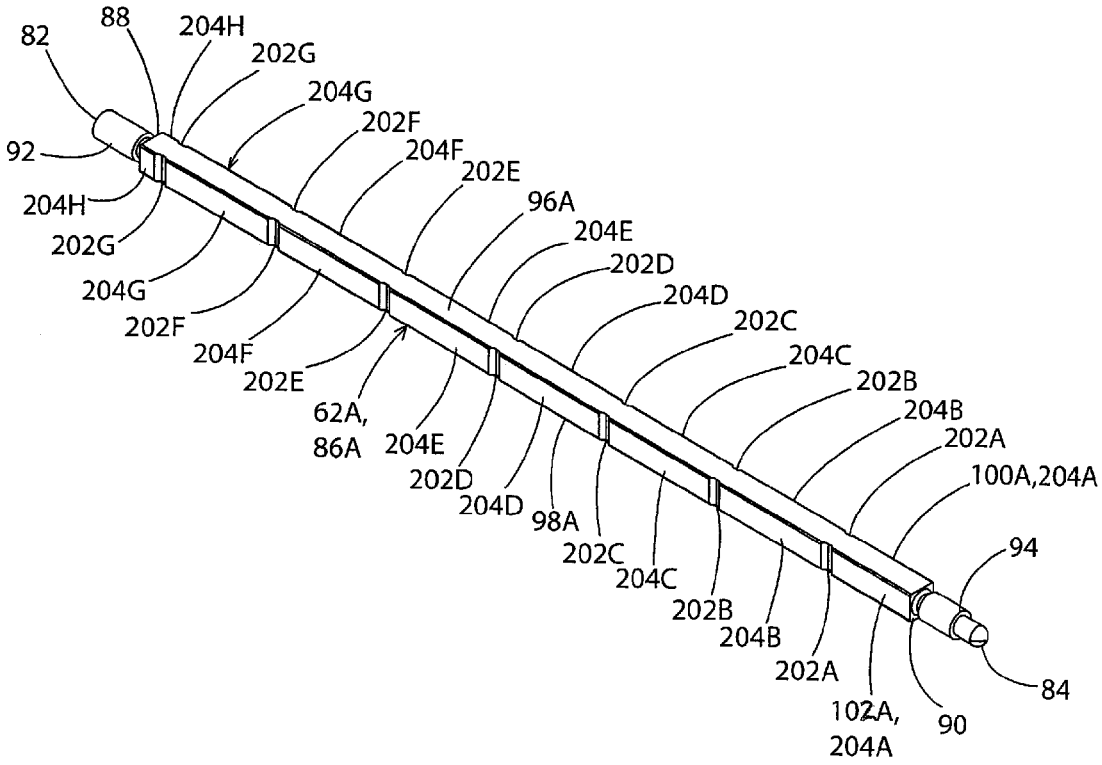
FIG. 16 is an enlarged perspective view of the second embodiment of the skewer.

With reference to FIG. 16, assembly 26A includes a straight longitudinally elongated skewer 62A which is similar to skewer 62 with some modifications. Skewer 62A has inner and outer ends 82 and 84 and includes inner segment 92 and outer segment 94 although outer segment 94 is optional inasmuch as there is no retaining member such as nut 64 used with skewer 62A. Instead, each part 4A includes its own retaining member or securing mechanism for holding the given piece 4A on skewer 62A. Skewer 62A includes an elongated square or non-circular shaft 86A which is similar to shaft 86 and includes inner and outer ends 88 and 90 positioned in the same manner as ends 88 and 90 of skewer 62. Similar to shaft 86, shaft 86A includes flat and straight horizontal top and bottom parallel flat surfaces 96A and 98A, and flat vertical front and rear surfaces 100A and 102A which are parallel to one another and perpendicular to surfaces 96A and 98A. However, shaft 86A is formed with a plurality of grooves or notches 202 which are longitudinally spaced from one another and extend inwardly from surfaces 100A and 102A. In the exemplary embodiment, each notch or groove 202 extends from top surface 96A to bottom surface 98A.

Figure 22:
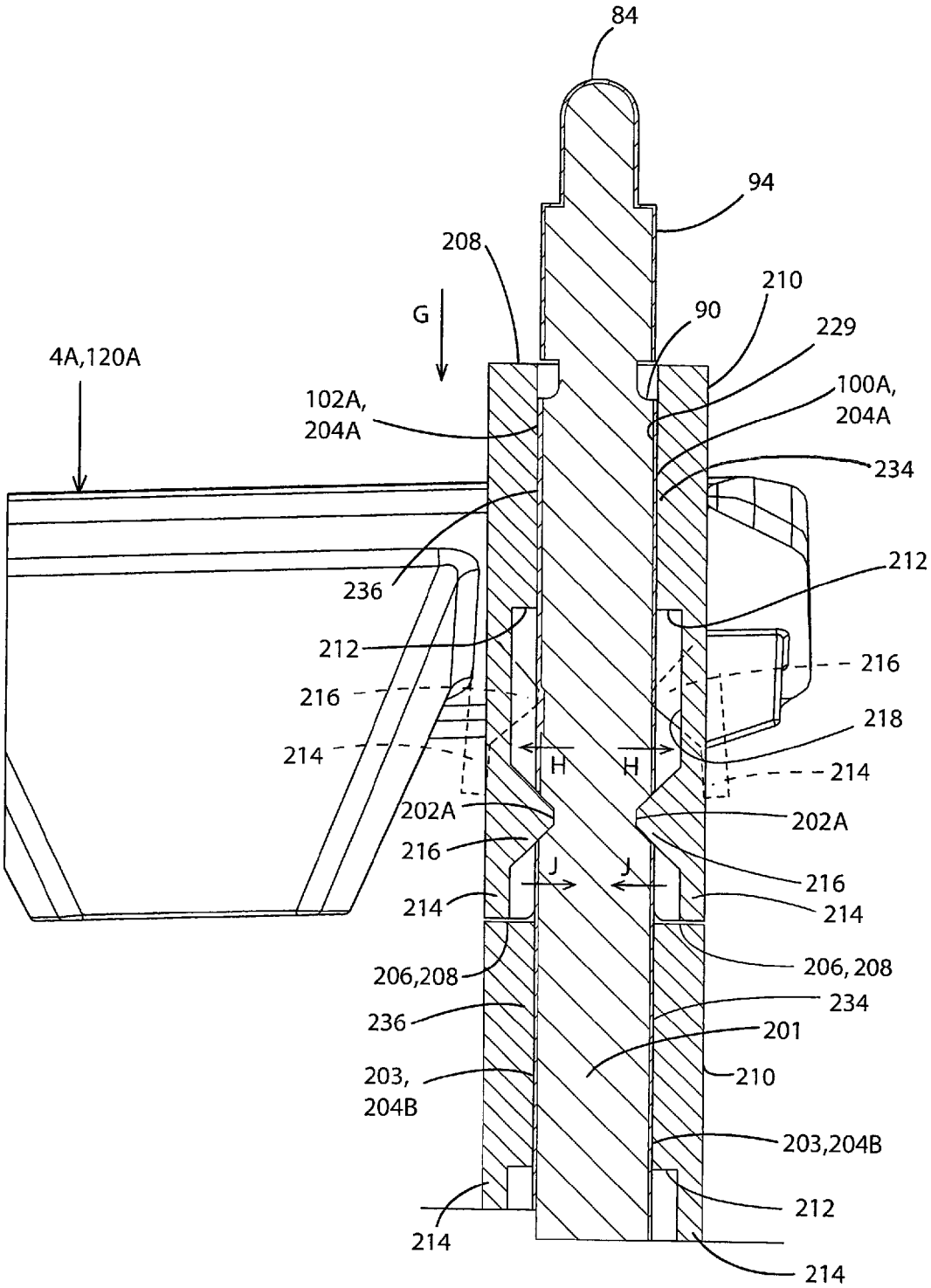
FIG. 22 is an enlarged sectional view taken on line 22-22 of FIG. 21.

More particularly, shaft 86A is formed with seven pairs of notches 202A-202G such that each notch of a given pair is directly opposite the other of that pair on the opposed side of shaft 86A. Thus, pair 202A of notches formed respectively in sides 100A and 102A is the pair which is closest to end 84 and furthest from end 82 (and upright 22 when skewer 62A is mounted thereon). The next adjacent pair is 202B, followed by 202C and so forth with grooves or notches 202G being closest to end 82 (and upright 22 when skewer 62A is mounted thereon) and furthest from end 84. The pairs of notches are longitudinally equally spaced from one another whereby each adjacent pair of notches defines a distance therebetween which is the same as the distance defined between any other adjacent pair of notches. Thus, the horizontal longitudinal distance defined between notches 202A and 202B is the same as that defined between notches 202B and 202C, between 202C and 202D and so forth. The grooves 202 divide surfaces 100A and 102A into longitudinally elongated flat surface segments 204A-H. The outermost segment 204A is defined between end 90 and outermost groove 202A. The innermost segment 204H is defined between end 88 and innermost groove 202G. The remaining flat segments 204 are defined between each adjacent pair of grooves 202. Thus, segment 204B is defined between grooves 202A and 202B, surface 204C is defined between grooves 202B and 202C, and so forth. As best shown in FIG. 22, nearly all of skewer 62A is formed of an electrically conductive metal rod 201 which is coated with an electrically non-conductive or dielectric coating 203. Coating 203 is typically a plastic material which may be, for example, Halar® or Kaynar from DuPont. Coating 203 is a relatively thin layer which coats the outer surface of skewer 62A at least from end 88 to end 84 with the exception of grooves 202 whereby the entire outer surface of skewer 62A from end 88 to end 84 is electrically non-conductive except for the metal surfaces of grooves 202, which thus serve as longitudinally spaced electrically conductive surfaces or electrical contacts. Grooves 202 thus provide longitudinally spaced openings through coating 203 which expose rod 201 to form these electrical contacts along rod 201. The various electrically conductive members of rack 2A provide an electrical pathway for conducting an electrical current from hooks 36 to rods 201 of skewers 26A and thus to pieces 4 when mounted on skewers 26A.

Figure 17:
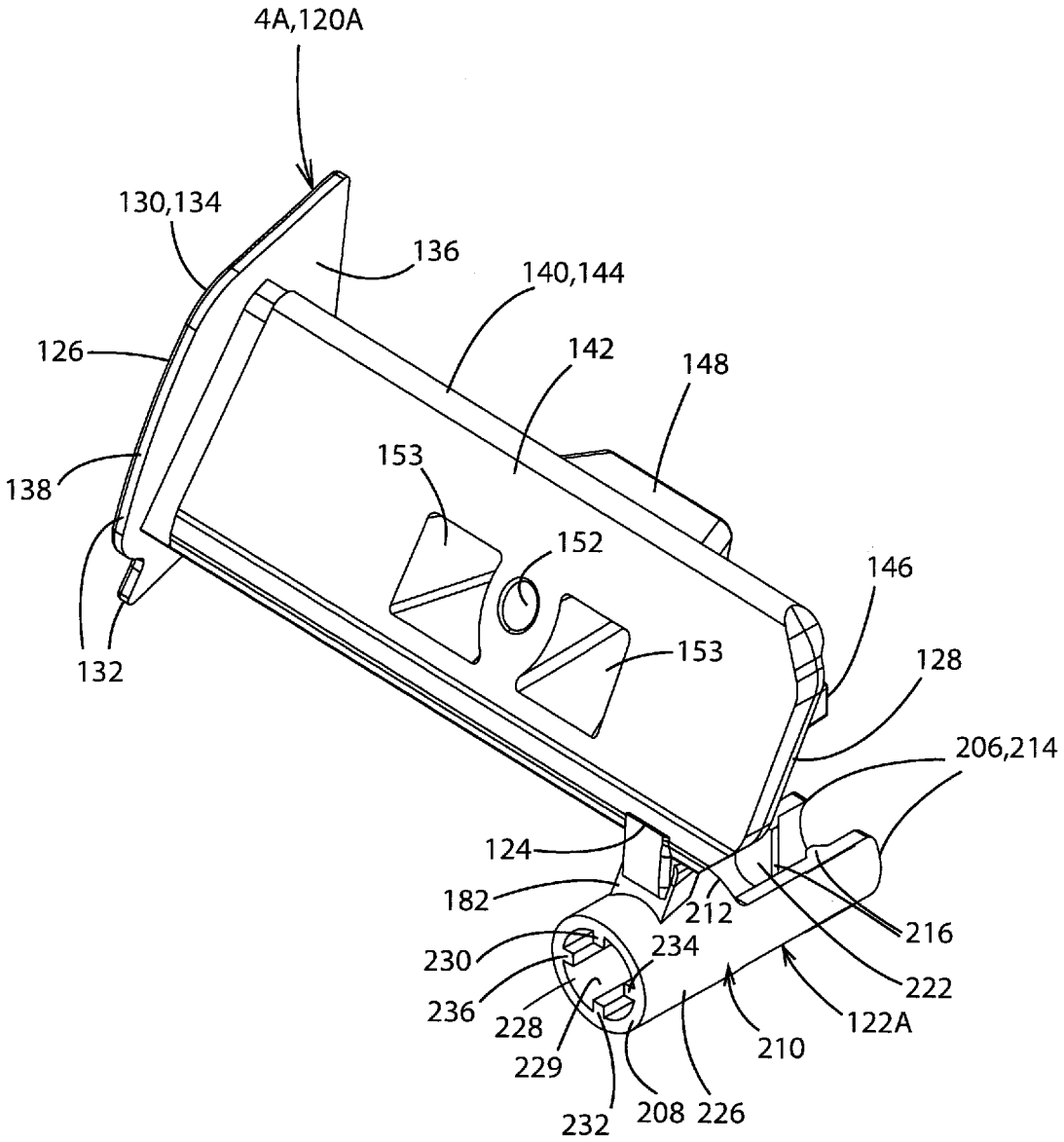
FIG. 17 is an enlarged perspective view of the second embodiment of the molded piece shown from the left, front and above.
Figure 18:
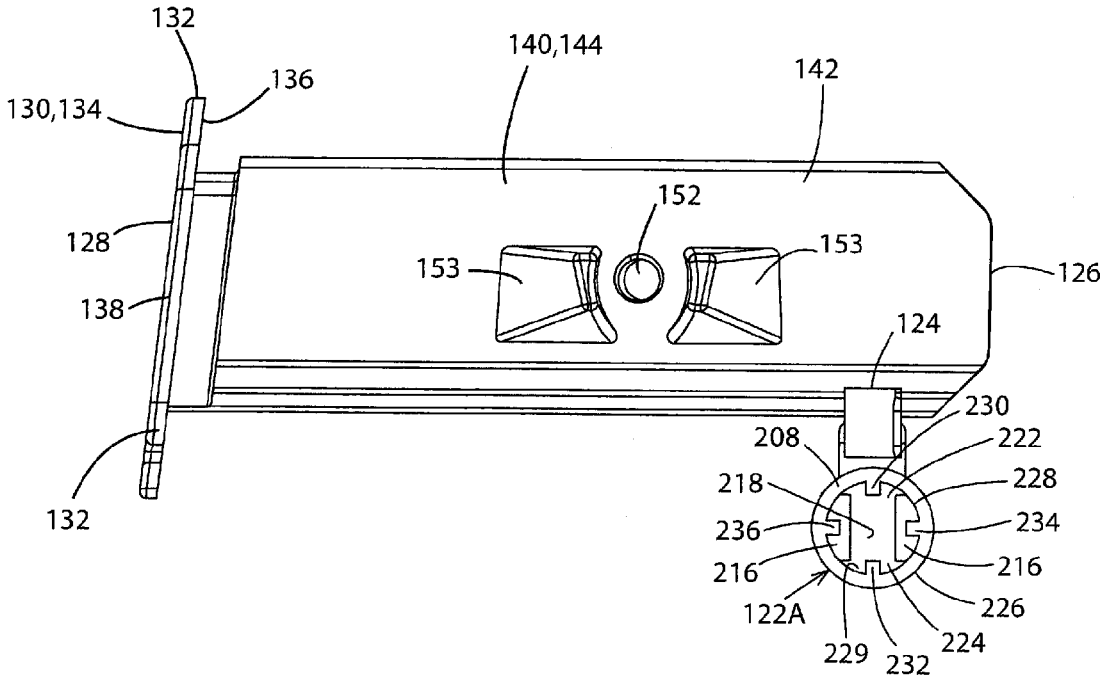
FIG. 18 is an enlarged left side elevational view of the molded piece of FIG. 17.
Figure 19:
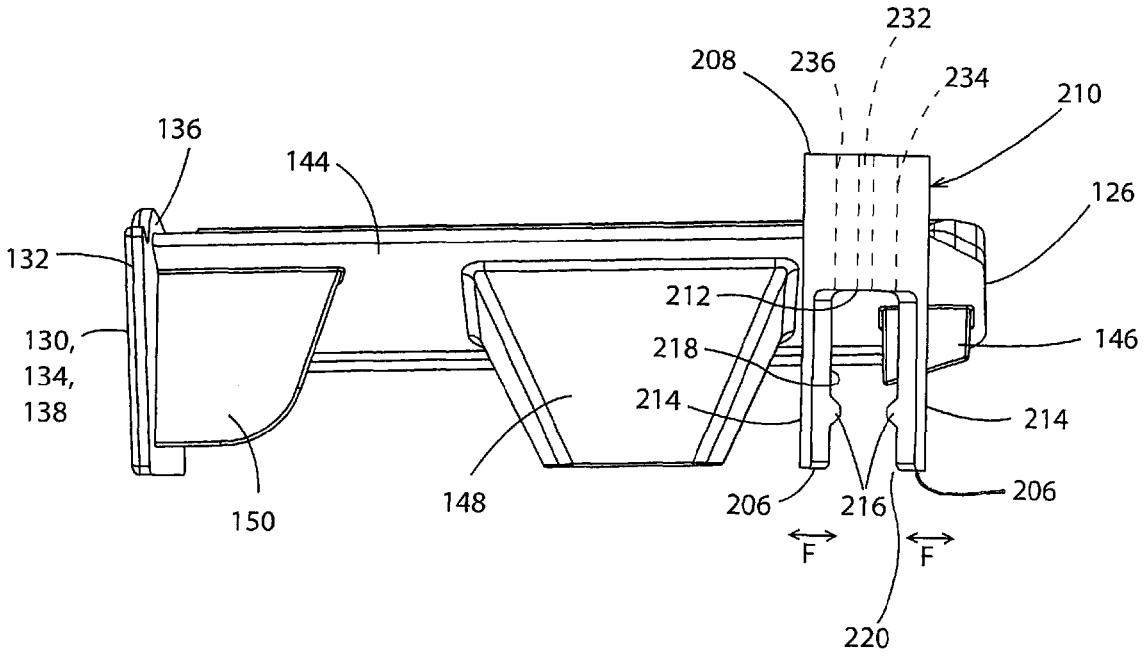
FIG. 19 is an enlarged bottom plan view of the molded piece of FIGS. 17 and 18.

Referring to FIGS. 17-19, piece 4A is described in greater detail. As previously noted, part 120A of piece 4A is similar to part 120 of piece 4 and is thus numbered similarly to denote the same or similar structures. Thus, part 120A is marked to indicate first and second ends 126 and 128, plate or decorative portion 130, contoured outer perimeter 132, first and second sides 134 and 136, essential plating surface 138, non-decorative portion 140, non-essential plating surface 142 and sections 144, 146, 148 and 150 along with hole 152 and recesses 153. Like piece 4, piece 4A is a plastic molded piece typically formed by injection molding as an integral one-piece member. Part 120A is joined to part 122A at a breakage, fracture or sever zone 124 in the same manner as with piece 4. However, fracture zone 124 of piece 4A is adjacent end 128, unlike fracture zone 124 of piece 4, which is generally adjacent end 126 of part 120.

With continued reference to FIGS. 17-19, part 122A has a first inner end 206 and an opposed second outer end 208 which in the exemplary embodiment are substantially flat, parallel and vertical when mounted on skewer assembly 26A. Part 122A includes a body in the form of a tube or collar 210 which extends from outer end 208 to an inner end 212 thereof which is intermediate and generally midway between ends 206 and 208. Part 122A further includes a pair of opposed cantilevered members comprising cantilevered arms 214 which are cantilevered from end 212 of collar 210 and extend outwardly therefrom to free ends which define inner end 206. A pair of mounting or securing tabs 216 of the cantilevered members are integrally formed with arms 214 and extend inwardly toward one another from the inner surfaces of arms 214. The inner surfaces of arms 214 define therebetween a skewer-receiving space 218 extending from end 212 to the free ends 206 of arms 214. Tabs 216 thus extend into space 218. Space 218 has an inner end entrance opening 220 defined between free ends 206 of arms 214. Space 218 also has a top entrance opening 222 defined by the tops of arms 214 and a bottom entrance opening 224 defined by the bottoms of arms 214. Collar 210 has a cylindrical or circular outer surface 226 which is continuous with the arcuate outer surfaces of arms 214. Collar 210 also has a cylindrical or circular inner surface 228 which defines a collar passage or through hole 229 which extends from end 208 to end 212 and communicates with space 218 at end 212. Also extending from end 208 to end 212 are four straight longitudinally extending parallel ribs which are more particularly denoted as top rib 230, bottom rib 232, front rib 234 and rear rib 236, each of which extends radially inwardly a short distance from inner surface 228 into passage 229 to respective terminal inner surfaces which are straight and flat. The terminal straight flat surfaces of top and bottom ribs 230 and 232 are horizontal whereas the corresponding rear and front flat surfaces of ribs 234 and 236 are substantially vertical.

Figure 20:
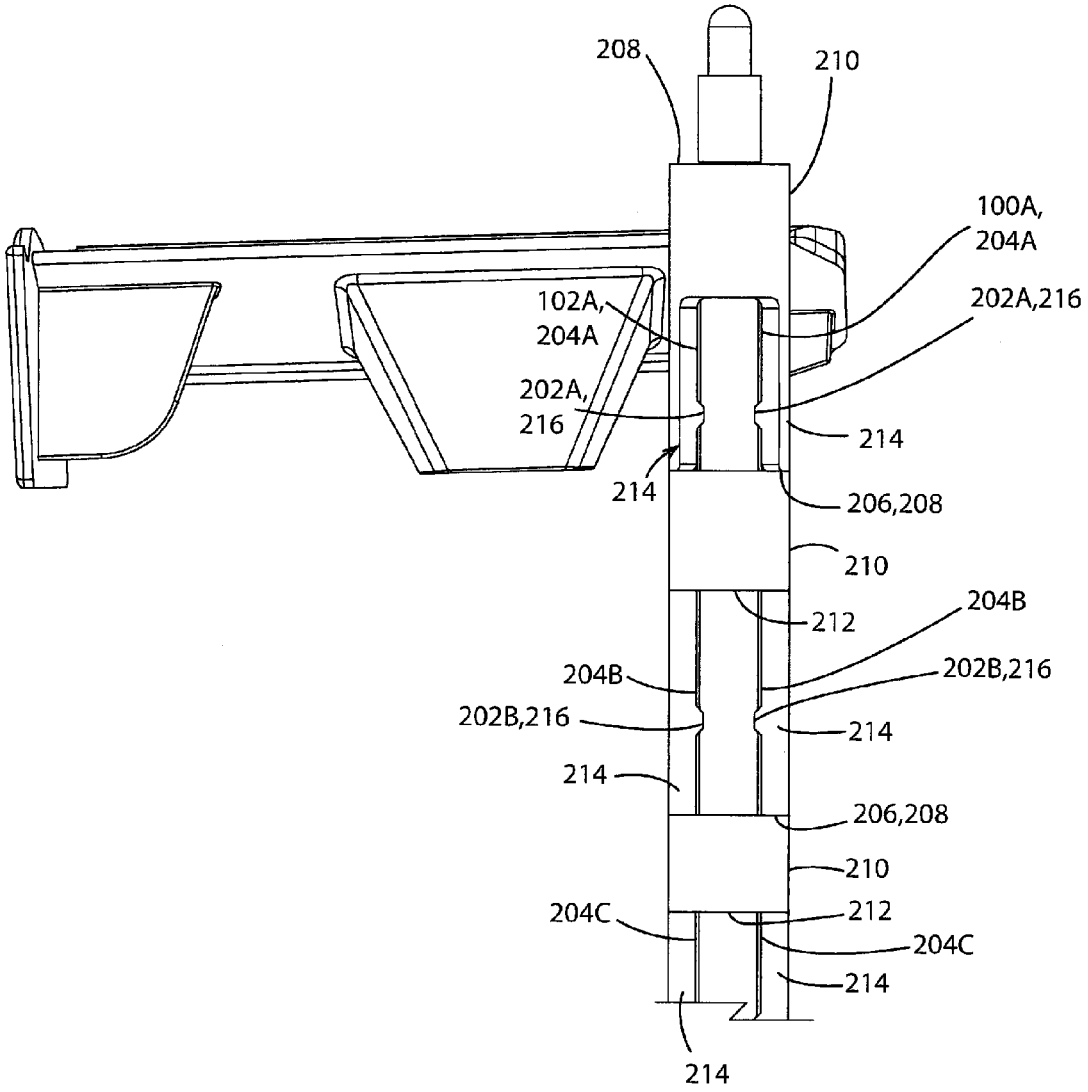
FIG. 20 is an enlarged bottom plan view of one of the second embodiments of the molded piece mounted on the second embodiment of the skewer assembly with the mounting parts of the second embodiment of the molded piece also shown mounted on the second embodiment of the skewer assembly.
Figure 21:
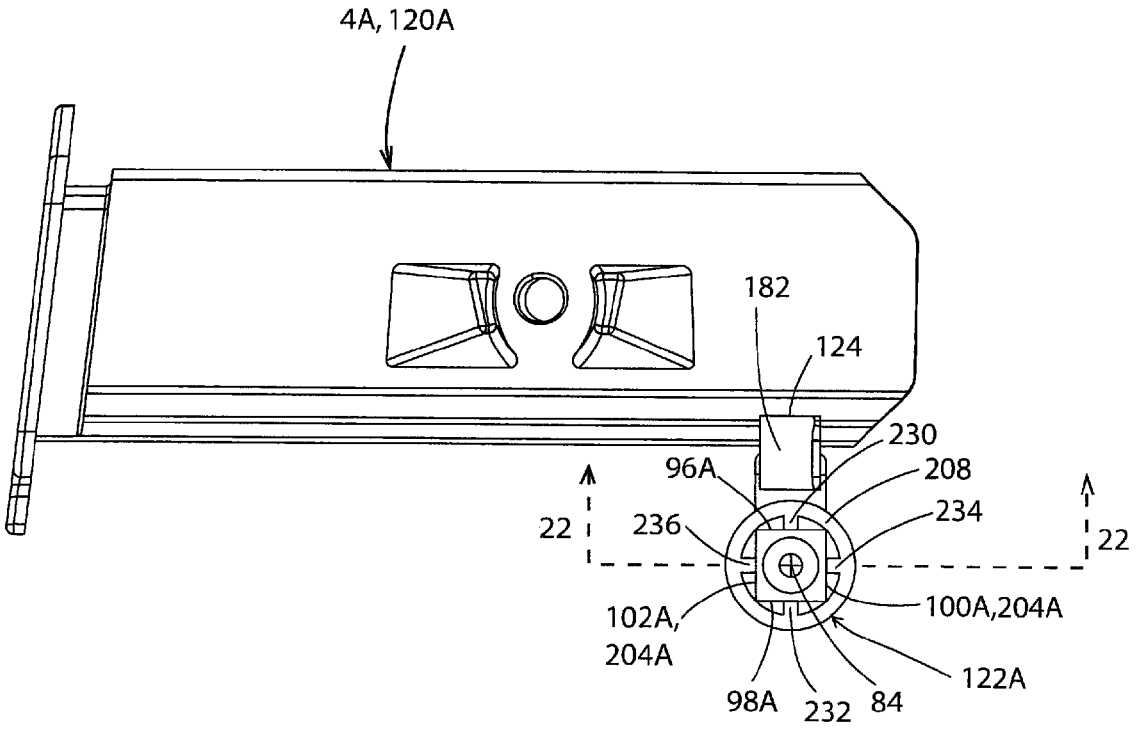
FIG. 21 is similar to FIG. 18 and shows a left side elevational view of the second embodiment of the molded part mounted on the second embodiment of skewer assembly.

FIGS. 20-22 show the mounted position of one or more pieces 4A on skewer 62A. When a piece 4A is mounted on and carried by skewer 62A, the notch engaging tabs 216 are disposed respectively in a pair 202 of the notches or grooves in shaft 86A. Thus, each pair of tabs 216 extends through the respective openings formed in coating 203 and contacts the electrical contact surfaces or grooves 202, which provides the only direct electrical contact between a given piece 4A and the electrically conductive rod 201. All other contact between piece 4A and skewer 62A is between piece 4A and coating 203 and thus does not provide any electrical contact therebetween. Most or all of the contact between part 4A and coating 203 occurs between the flat surfaces of shaft 86A and the ribs within collar passage 229. More particularly and with reference to FIG. 21, the horizontal inner bottom surface of top rib 230 contacts the top flat surface 96A, the horizontal inner top surface of rib 232 contacts the downwardly facing bottom flat surface 98A, the rear inner vertical surface of rib 234 contacts the front vertical flat surface 100A, and the front inner vertical surface of rib 236 contacts the rear flat surface 102A. In addition, the inner surfaces of arms 214 are closely adjacent and may be in contact with coating 203.

Figure 23:
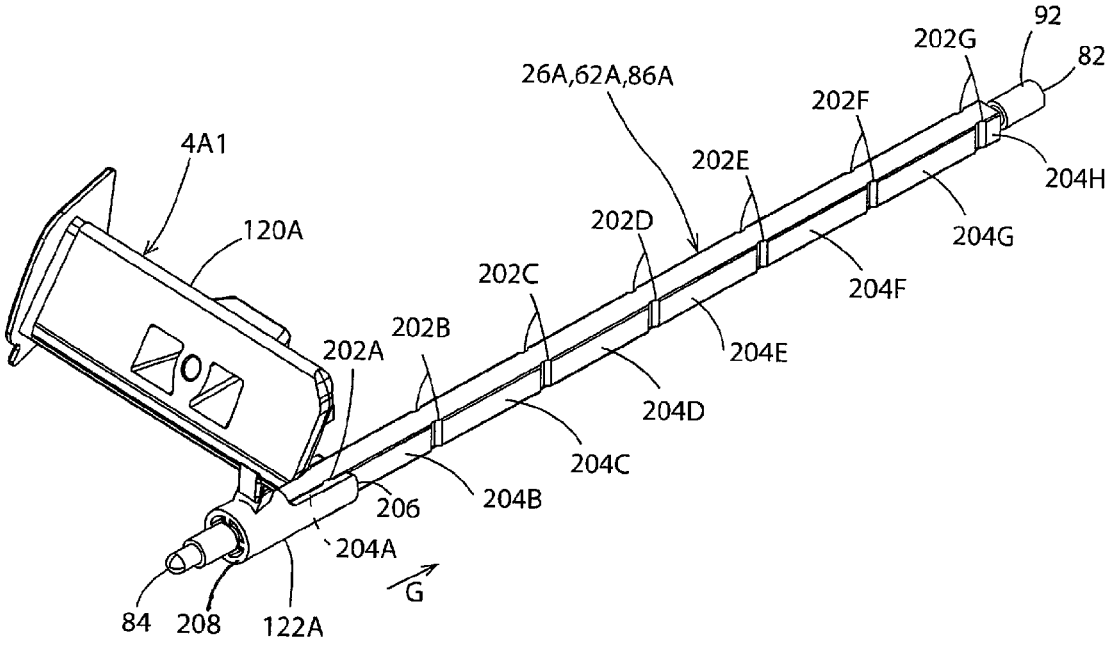
FIG. 23 is a perspective view of the second embodiment of the skewer with one of the second embodiments of the molded pieces mounted on the outer end thereof with the tabs of the molded piece engaged within the outermost notches of the skewer.
Figure 24:
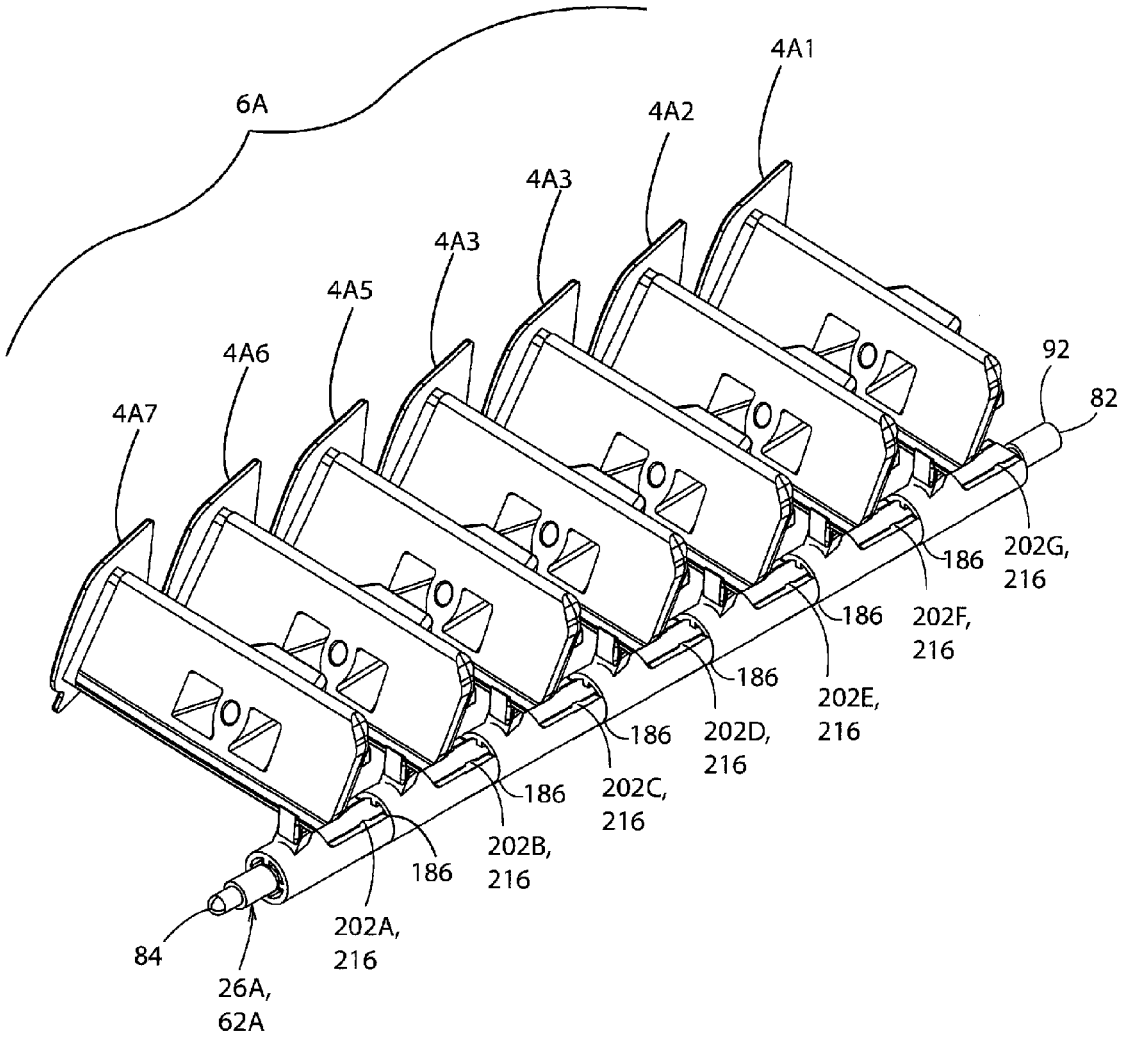
FIG. 24 is similar to FIG. 23 and shows the full assembly of the second embodiment of molded pieces mounted on one of the second embodiment skewers wherein the mounted assembly includes seven of the second embodiment mold pieces.

The mounting of pieces 4A on skewer 62A to form assembly 6A is now described with reference to FIGS. 22-24. Unlike the collars 122 of pieces 4A, mounting parts 122A are not configured to join with one another with a press fit, snap fit or the like. Instead, the ends of the mounting parts 122A are closely adjacent or simply abut one another when the assembly 6A is formed. Pieces 4A are removably joined to one another by being removably secured to skewer 62A. Initially, as shown in FIG. 23, the mounting part 122A of a first piece 4A1 is slid over the outer end 84 of skewer 62A with end 206 serving as a leading end and end 208 as a trailing end as the piece is slid toward inner end 82 as shown at Arrow G. During this sliding movement, shaft 86A is slidably received in passage 229 and the inner ends of ribs 230, 232, 234 and 236 respectively slidably engage surfaces 96A, 98A, 100A and 102A of outer coating 203. The inner surfaces of tabs 216 likewise slidably engage surfaces 100A and 102A respectively. The sliding engagement between tabs 216 and surfaces 100A and 102A first occurs along the outermost flat segments 204A until tabs 216 reach the outermost pair 202A of grooves. As shown at FIG. 22, the sliding movement (Arrow G) in which tabs 216 slidably engage surfaces 100A and 102A causes arms 214 along with tabs 216 to flex outwardly as the inner ends 206 of arms 214 to spread apart or move away from one another (Arrows H to dashed line position) during this pivotal flexing movement about the connection of arms 214 and end 212 of collar 210. Once tabs 216 reach the first pair of grooves 202A, the resilient nature of the plastic material spring biases the arms 214 and tabs 216 toward one another to snap inwardly into grooves 202A (Arrows J).

The person loading pieces 4A then continues to push or slide piece 4A1 inwardly along skewer 62A whereby the previously noted sliding engagement occurs between outer surfaces of shaft 86A, the ribs of collar 210 and tabs 216, which slide along the flat segments 204B, 204C and so forth in a sequential manner with arms 214 flexing outwardly as they ride along the flat surface segments 204 and flexing inwardly as they reach each pair of grooves 202 consecutively. The person loading the pieces ultimately pushes piece 4A1 to the innermost position shown in FIG. 24 with tabs 216 within grooves 202G providing a snap fit connection between piece 4A1 and skewer 62A which serves as a securing mechanism securing the piece to the skewer. The loader will sequentially load the remaining pieces 4A2, 4A3 and so forth through piece 4A7 in the same manner such that tabs 216 of piece 4A2 are within grooves 202F, tabs 216 of piece 4A3 are within grooves 202E and so forth. Each piece 4A forms a snap fit connection with skewer 62A to secure the piece thereon.

Sliding piece 4A2 into its mounted position on skewer 62A forms a two-piece assembly of pieces 4A1 and 4A2, then sliding piece 4A3 into its mounted position on skewer 62A forms a three-piece assembly of pieces 4A1, 4A2 and 4A3, and so forth to sequentially form four-piece, five-piece, six-piece and seven-piece assemblies. During loading, there is a sequential sliding engagement between the tabs 216 of piece 4A1 and each of flat segments 204A-204G, between the tabs 216 of piece 4A2 and each of flat segments 204A-204F, between the tabs 216 of piece 4A3 and each of flat segments 204A-204E, between the tabs 216 of piece 4A4 and each of flat segments 204A-204D, between the tabs 216 of piece 4A5 and each of flat segments 204A-204C, between the tabs 216 of piece 4A6 and each of flat segments 204A-204B, and between the tabs 216 of piece 4A7 and flat segment 204A. For each of pieces 4A, this sliding engagement begins at outer end 90 adjacent outer end 84 and continues only through the above-noted flat segments 204 inasmuch as the sliding movement of each piece 4A stops when its tabs 216 enter the notches 202 associated with its final mounted position.

The present paragraph describes the pieces 4A in their mounted position on skewer 62A. As previously noted, once all of the seven pieces 4A are mounted to form assembly 6A on skewer 62A, mounting parts 122A are in end-to-end contact with one another or closely adjacent one another. More particularly, when all seven pieces are mounted on skewer assembly 26A, inner end 206 of piece 4A1 is closely adjacent or in contact with outer end 68 of mounting member 60, inner end 206 of piece 4A2 is closely adjacent or in contact with outer end 208 of piece 4A1, inner end 206 of piece 4A3 is closely adjacent or in contact with outer end 208 of piece 4A2, inner end 206 of piece 4A4 is closely adjacent or in contact with outer end 208 of piece 4A3, inner end 206 of piece 4A5 is closely adjacent or in contact with outer end 208 of piece 4A4, inner end 206 of piece 4A6 is closely adjacent or in contact with outer end 208 of piece 4A5, inner end 206 of piece 4A7 is closely adjacent or in contact with outer end 208 of piece 4A6, and outer end 208 of piece 4A7 is adjacent outer end 84 of skewer 62A. Respective portions of top surface 96A of the skewer are visible through the top entrance openings 222 of the various mounted pieces 4A and respective portions of bottom surface 98A of the skewer are visible through the bottom entrance openings 224 of the various mounted pieces 4A. The inner end entrance openings 220 of all pieces 4A except the innermost piece 4A1 communicates with the passage 229 of the adjacent piece 4A. Openings 220, 222, 224 thus serve as drain openings which facilitate draining liquid from pieces 4A when the rack with pieces 4A mounted thereon are removed from the various liquid baths in which they are immersed during the electroplating process. Piece 4A1 is adjacent upright 22; piece 4A7 is distal upright 22; piece 4A2 is horizontally longitudinally further from upright 22 than is piece 4A1; piece 4A3 is horizontally longitudinally further from upright 22 than are pieces 4A2 and 4A1; piece 4A4 is horizontally longitudinally further from upright 22 than are pieces 4A1-4A3; piece 4A5 is horizontally longitudinally further from upright 22 than are pieces 4A1-4A4; piece 4A6 is horizontally longitudinally further from upright 22 than are pieces 4A1-4A5; and piece 4A7 is horizontally longitudinally further from upright 22 than are pieces 4A1-4A6. Final-shape parts 120A extend axially outward away from the respective mounting part 122A and skewer 62A. Parts 120A of the various pieces 4A are longitudinally adjacent and spaced from one another so that parts 120A are not in contact with one another. Plates 130 and essential surfaces 138 are generally aligned along a common plane and face in the same direction.

Figure 25:
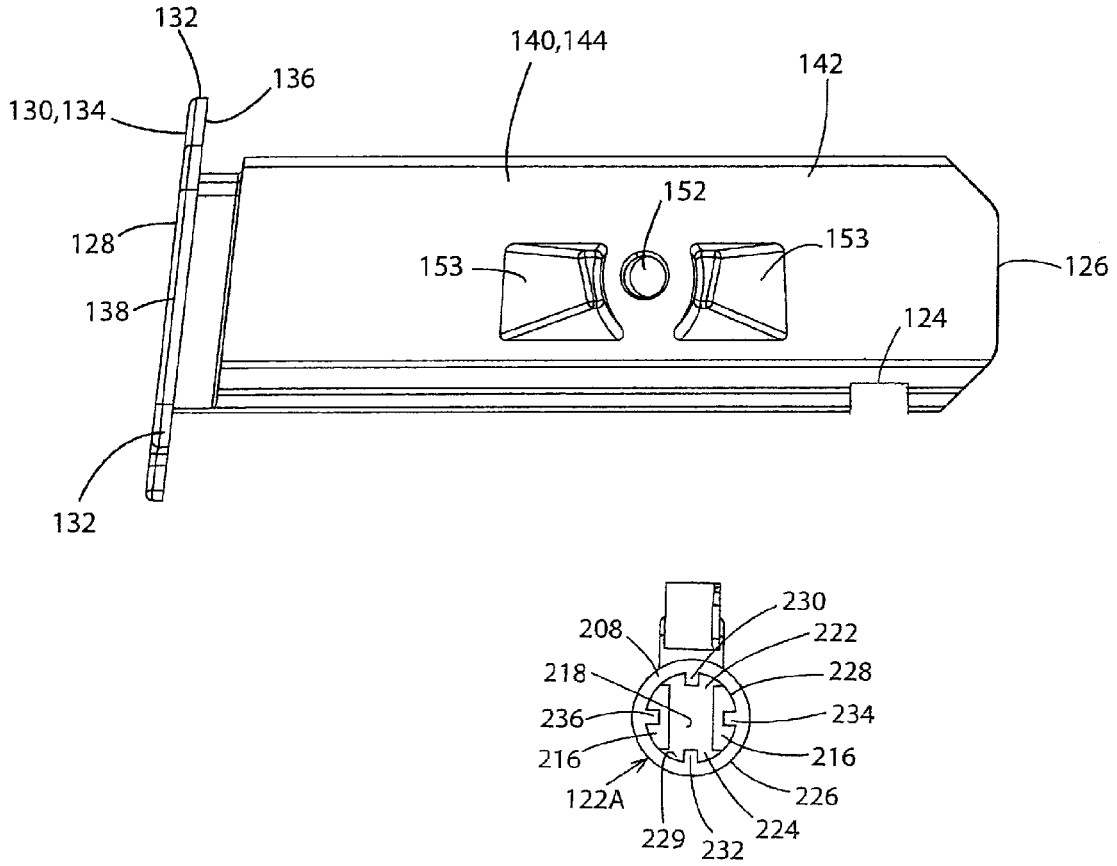
FIG. 25 is similar to FIG. 18 and shows the finished part of the second embodiment molded piece broken off and separate from the mounting part of the molded piece.

If desired, electrically conductive adhesive 186 may also be between the ends 206 and 208 of the respective adjacent parts 122A which abut one another in the joined or assembled configuration of pieces 4A on skewer 62A. Thus, adhesive 186 may also serve to join pieces 4A to one another or enhance the joints therebetween and provide electrical communication therebetween. Once the pieces 4A are mounted on skewer 62A, they will not come off absent an outward sliding force parallel to central longitudinal axis X2 of skewer 62A away from end 82 and toward end 84, due to the securing mechanism provided by tabs 216 within a respective pair of grooves 202. However, pieces 4A may be relatively easily removed by hand simply by pulling on the piece to overcome the inward spring bias of arms 214 which hold tabs 216 within grooves 202. Once a full array of assemblies 6A of pieces 4A are mounted on all of the skewer assemblies 26A of the rack to form an electroplating assembly, the rack and pieces will be dipped or immersed in the various baths to undergo the electroplating process, whereby the essential coating surface 138 will be plated with a thin metal plate P shown in FIG. 25. As with pieces 4, pieces 4A are then manually or otherwise broken apart or severed from one another along sever zone 124 whereby parts 120A and 122A are separate from one another in the same manner discussed with parts 120 and 122 of piece 4.

Unlike system 1, system 200 thus does not use a single separate securing member like member 64 which secures all of the pieces 4A on skewer 62A. Instead, pieces 4A are integrally formed with securing members or tabs 216 which are longitudinally spaced along skewer 62A within the respective notches 202. System 200 thus provides securing mechanisms and members respectively for pieces 4A such that the securing mechanism/member of piece 4A1 is adjacent inner end 82 and upright 22 while the securing mechanism/member of piece 4A7 is adjacent outer end 84 and distal inner end 82 and upright 22. The securing mechanism/members of pieces 4A1-4A7 are thus positioned relative to upright 22 in the same manner as are pieces 4A1-4A7 themselves, as described above, that is, horizontally longitudinally further or closer to upright 22 and inner end 82.

Electroplating system 250 includes a rigid electroplating rack frame 2B formed of electrically conductive members which are in electrical communication with one another for removably mounting thereon assemblies 6B of identical molded plastic pieces 4B which are joined to one another. Rack 2B has a top and bottom 8 and 10, front and back 12 and 14 defining therebetween an axial direction, and left and right sides 16 and 18 defining therebetween a longitudinal direction. The electrically conductive members are formed of metal and include parallel left, center and right uprights 252, 254 and 256, top and bottom longitudinal bars 258 and 260 and a plurality of left and right T-bars 262 which include longitudinal bars 264 and axial bars 266, and front and rear U-shaped clips 268A and B secured respectively to the front and rear ends of axial bars 266. Electrically conductive hooks 36A are also secured to the top of the other frame members and extend upwardly therefrom. Top longitudinal bar 258 is rigidly secured to the top ends of uprights 252, 254 and 256. Likewise, bottom bar 260 is rigidly secured to the bottom ends of uprights 252, 254 and 256. Left T-bars 262A are rigidly secured to the right side of left upright 252 and the right side of center upright 254 and extend to the right therefrom. Left T-bars 262 are rigidly secured to and extend left from the left side of center upright 254 and the left side of right upright 256. More particularly, each longitudinal bar 264 is rigidly secured to one of the uprights and extend outwardly therefrom with axial bar 266 extending forward and rearward from the free end of longitudinal bar 264 such that front and rear clips 268A and B are secured respectively to the front and rear ends of each axial bar 266. T-bars 262 are vertically spaced from one another and longitudinally spaced from one another so that they form pairs at the same height as one another such that the front clips 262A of a given pair define therebetween a longitudinally elongated generally horizontal front piece-receiving or assembly-receiving space 270A and a rear pair of clips 268A of a given pair of T-bars defining between a longitudinally elongated generally horizontal rear piece-receiving or assembly-receiving space 270B. Thus, portions of the set 6B mounted on a given pair of front clips 268A are within front space 270A and mounted. Likewise, portions of the pieces 4B of an assembly 6B mounted on a rear pair of clips 268B are within space 270B. The various electrically conductive members of rack 2B provide an electrical pathway for conducting an electrical current from hooks 36A to clips 268 and thus to pieces 4B when mounted on clips 268.

Figure 27:
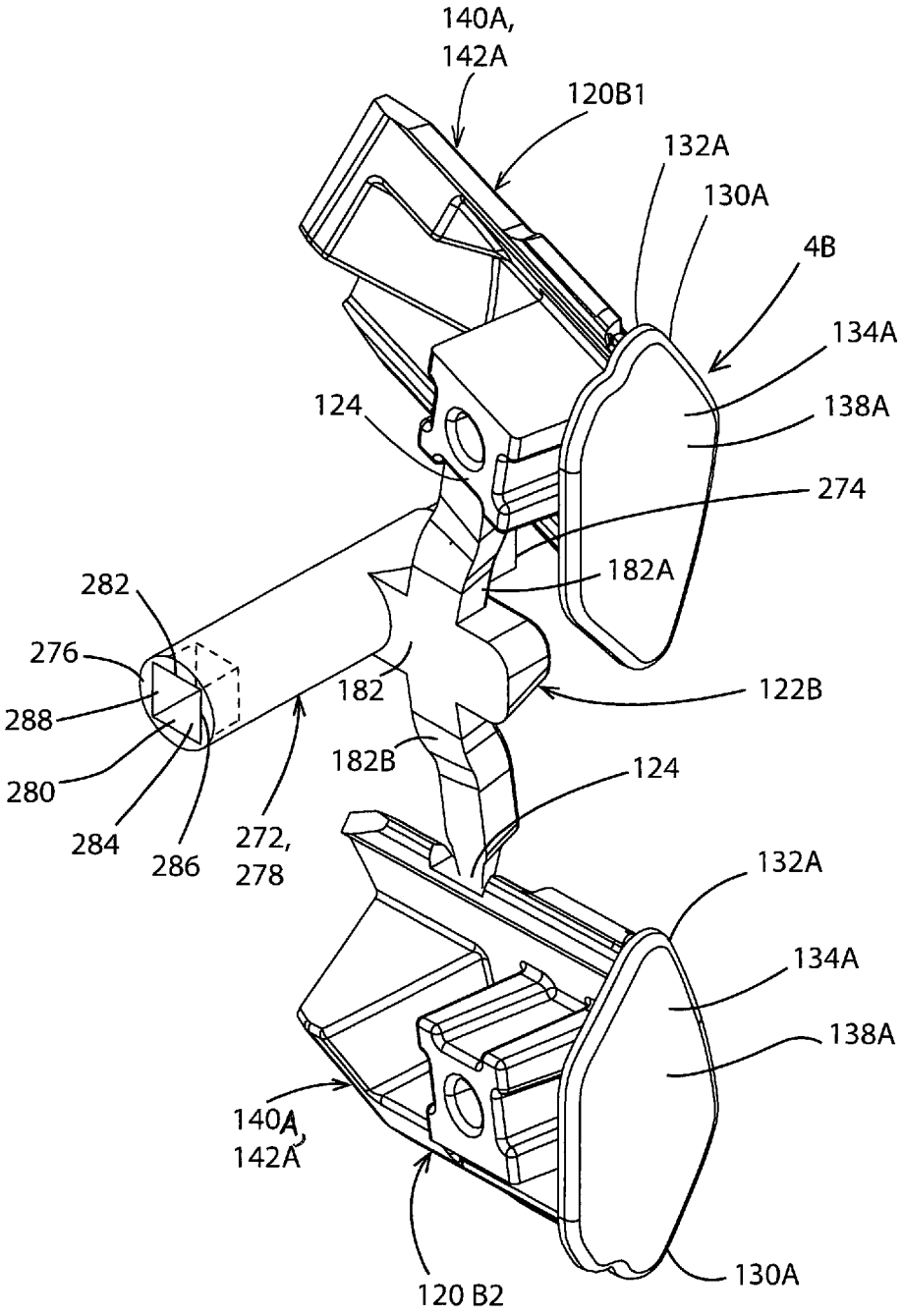
FIG. 27 is an enlarged perspective view taken from the left, front and above of the third embodiment of the molded piece.
Figure 28:
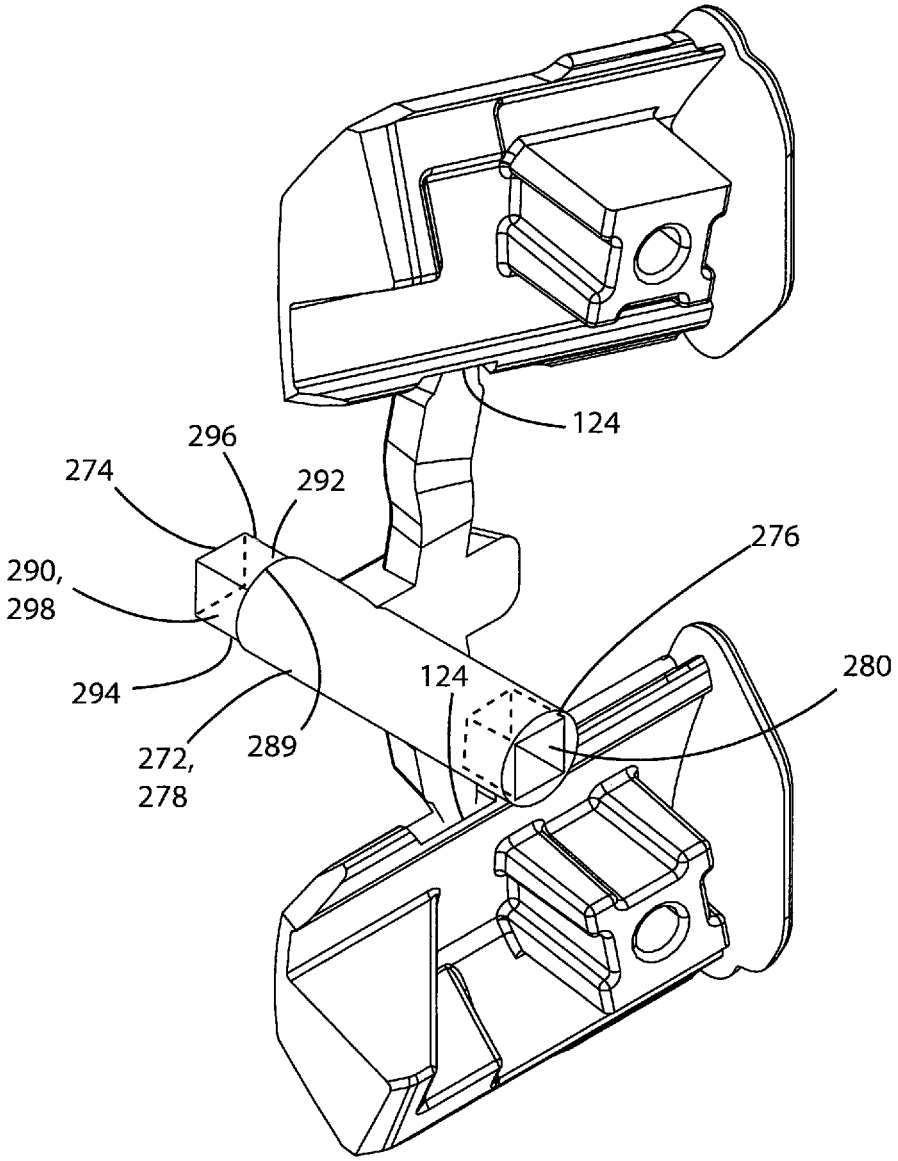
FIG. 28 is an enlarged perspective view of the third embodiment of the molded piece as viewed from the rear, left and above. Relative to the orientation of FIG. 27, the molded piece of FIG. 28 is rotated approximately 90 degrees about a vertical axis counterclockwise as viewed from above.

Referring now primarily to FIGS. 27 and 28, pieces 4B are configured to be removably joined to one another to form assemblies 6B and include 2 final-shape parts 120B1 and 120B2 which are joined to a mounting or joining part 122B at respective fracture or sever zones 124. Although each piece 4B is different than the other pieces 4 and 4A, they still have a generally similar configuration which includes a generally flat plate 130 having a generally flat side 134A and an outer perimeter 132A with an essential or class A plating surface 138A which includes the outer surfaces of side 134A and perimeter 132A. Each part 4B further includes a non-decorative portion 140A, the outer surface of which is a non-essential or potential coating surface 142A. Like the other pieces 4 and 4A, piece 4B has various sections which project outwardly relative to one another but are not described in detail here.

Joining part 122B includes a longitudinal member or rod 272 having a first inner end 274 and a second outer end 276 with a cylindrical outer surface 278 extending therebetween. A square or non-circular recess or cavity 280 is formed in rod 272 extending inwardly from end 276 toward end 274. Cavity 280 is bounded by an inner surface which includes horizontal top and bottom flat surfaces 282 and 284, and vertical front and rear flat surface 286 and 288 which are parallel to one another and perpendicular to surfaces 282 and 284. Outer surface 278 more particularly extends from end 276 to an annular shoulder 289 adjacent end 274. Rod 272 further includes a square or non-circular insert 290 which extends outwardly from shoulder 289 to end 274. Insert 290 has horizontal top and bottom flat surfaces 292 and 294, and vertical front and rear flat surfaces 296 and 298 which are parallel to one another and perpendicular to surfaces 290 and 292. Part 122B further includes a neck 182 which is secured to and extends outwardly from outer surface 278 and includes first and second branching neck portions 182A and 182B which respectively extend upwardly and downwardly from neck 182. One of the sever zones 124 is located between the terminal outer upper end of neck portion 182A whereas the other sever zone 124 is located at the terminal outer lower end of neck portion 182B.

Figure 30:
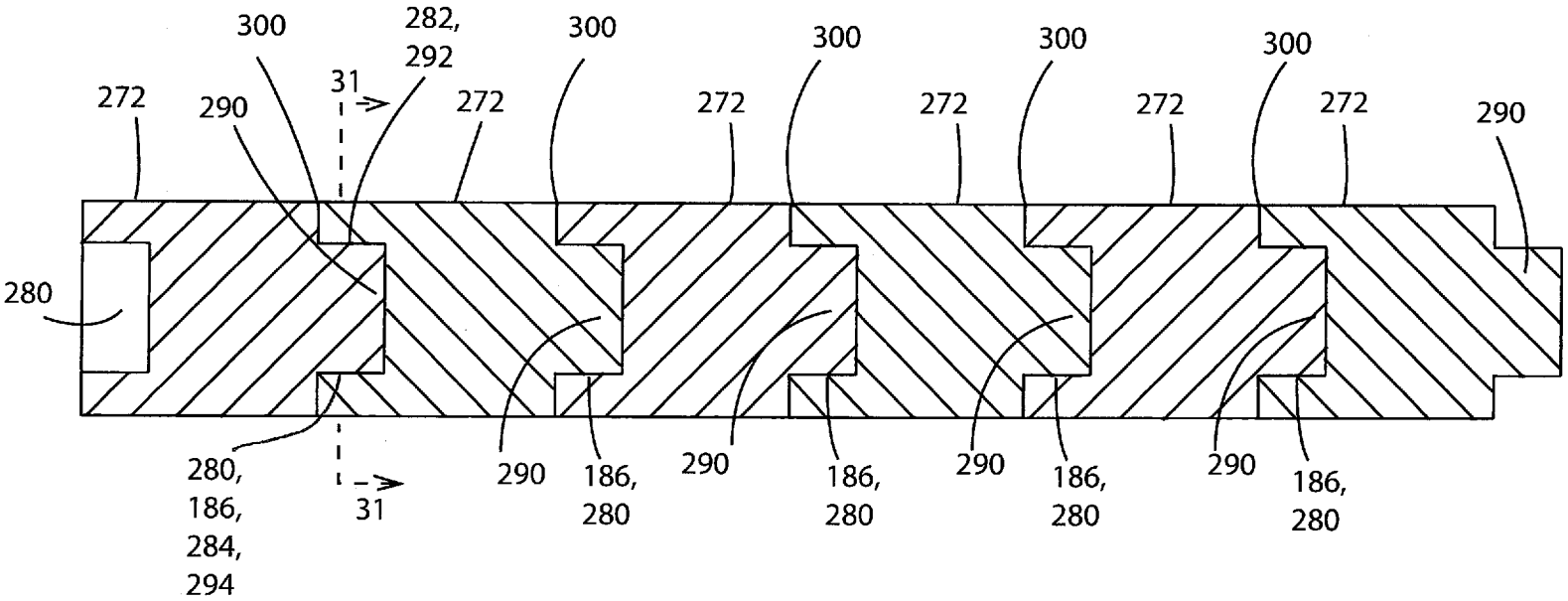
FIG. 30 is an enlarged sectional view taken on line 30-30 of FIG. 29.
Figure 31:
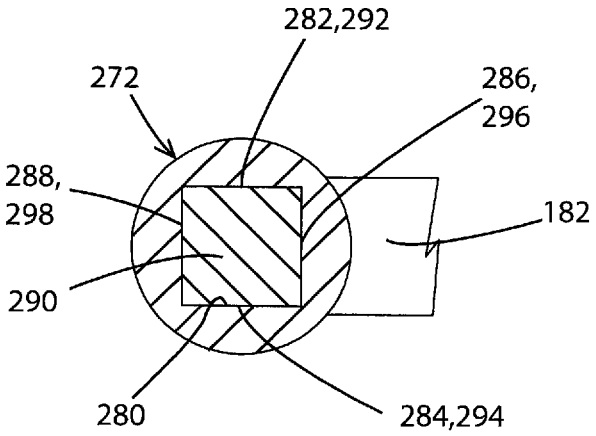
FIG. 31 is an enlarged sectional view taken on line 31-31 of FIG. 30.

Similar to pieces 4, pieces 4B are joined to one another by a press fit connection or a snap fit connection. In the exemplary embodiment, insert 290 of each joining member 122B is inserted into the cavity 280 of another piece 4B to join the two pieces to one another. Like in the first embodiment, several pieces 4B are joined in this manner to create assembly 6B which in the exemplary embodiment includes six pieces 4B joined to one another in an end-to-end fashion. FIGS. 30 and 31 show the connection between the various rods 272 of the six pieces 4B. Insertion of each of inserts 290 into the respective cavity 280 thus forms a joint 300 between each adjacent pair of rods 272 which may include adhesive 186 between the mating surfaces of the joint, such as between surfaces 282 and 292, surfaces 284 and 294, surfaces 286 and 296, and surfaces 288 and 298.

Figure 29:
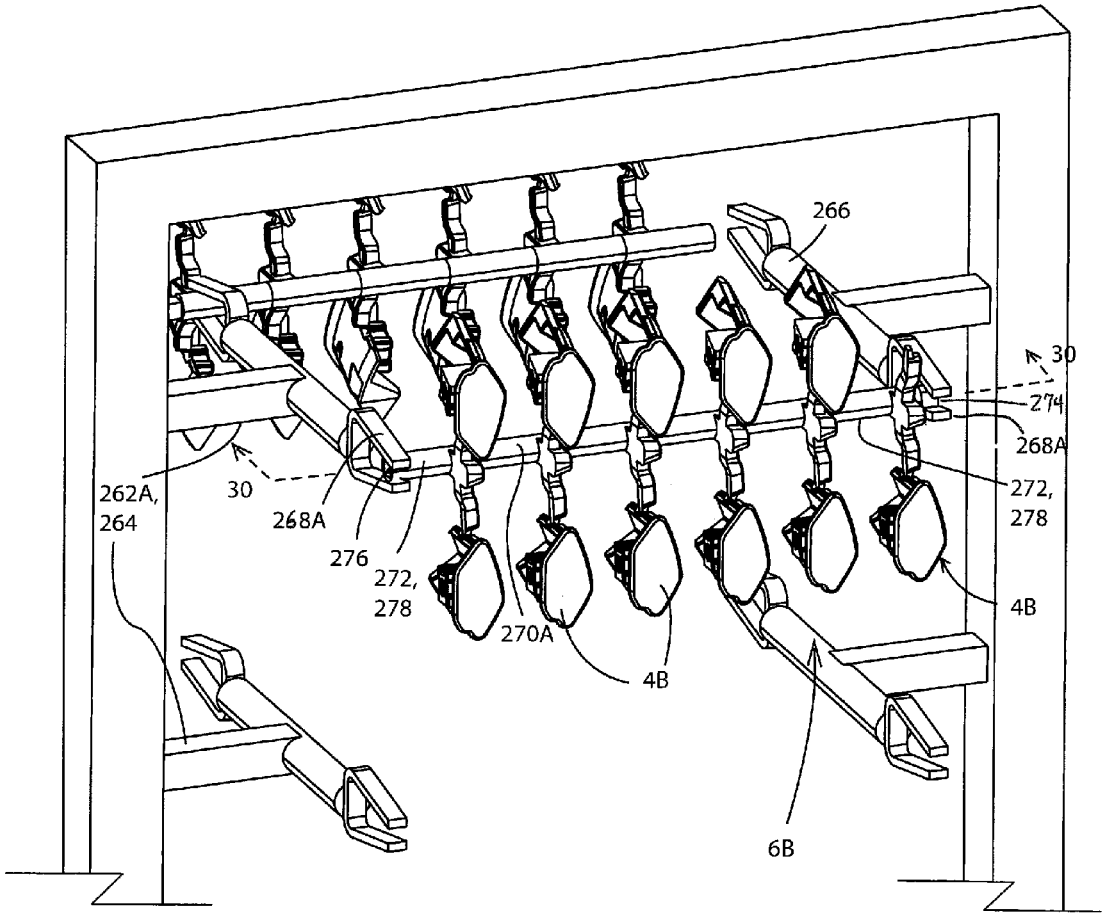
FIG. 29 is an enlarged perspective view of an upper portion of the third embodiment of the rack shown in FIG. 26 showing a single assembly of the third embodiment molded pieces mounted on a pair of clips of the rack.

Once each of pieces 4B is joined to one another to form unit or assembly 6B, the assembly is ready to be mounted on rack 2B as shown in FIG. 29 via a pair of clips 268 which are shown as the front clips 268A in FIG. 29. The assembly 6B is suspended between the two clips 268A with two spring arms of the left metal clip 268A gripping and contacting outer surface 278 of rod 272 of the leftmost piece 4B and two spring arms of the right metal clip 268A engaging and gripping the outer surface 278 of rod 272 of the rightmost piece 4B. More particularly, the left clip 268A engages and secures the leftmost piece adjacent end 276 while right clip 268A engages and secures the rightmost piece 4B adjacent end 274. The left and right clips of a given pair are thus the only support provided for assembly 6B which allows rack 2B to carry a given assembly 6B. The four interior or intermediate clips 4B between the leftmost and rightmost end clips 4B are thus supported only by the various joints 300 therebetween.

Figure 32:
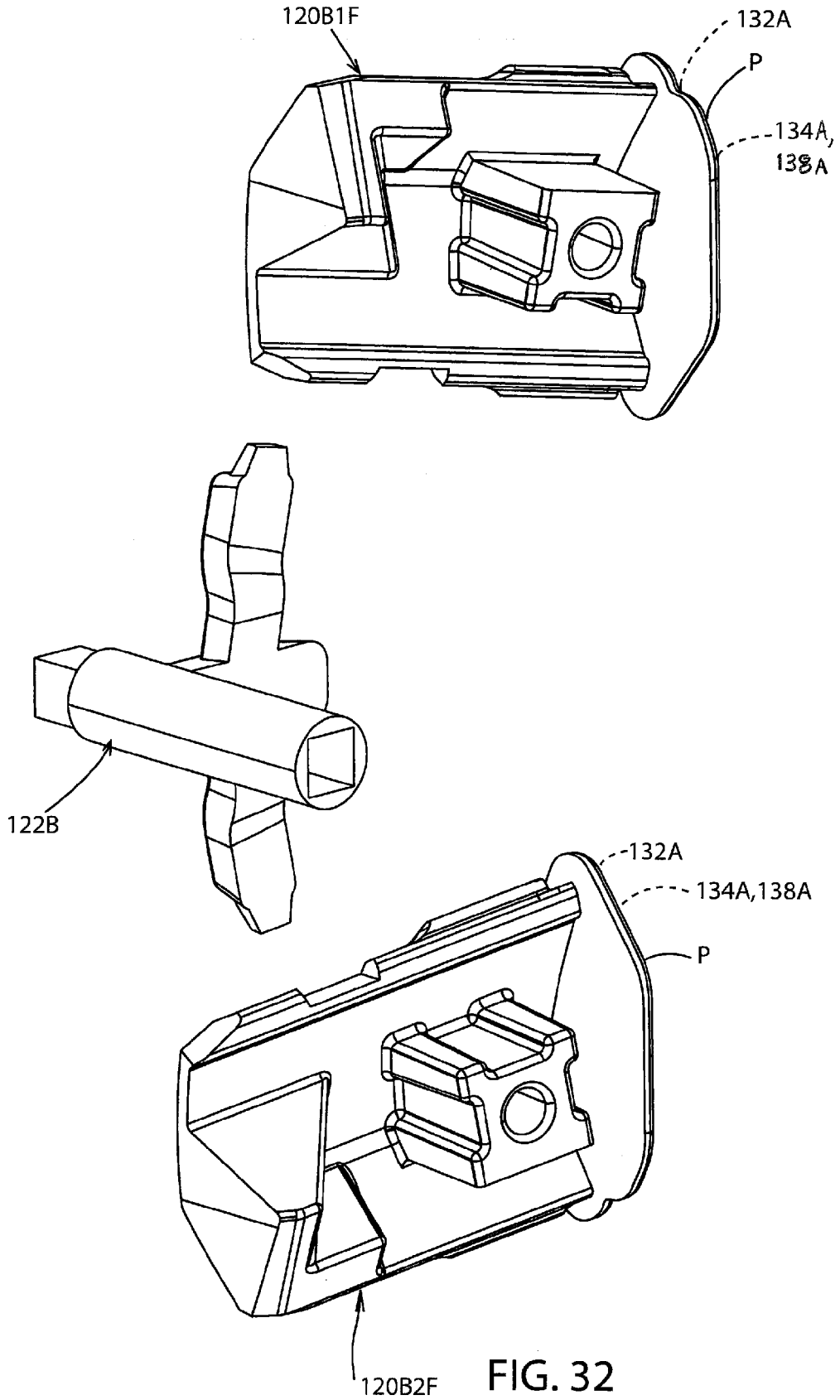
FIG. 32 is similar to FIG. 28 and shows the two finished parts of the third embodiment of the molded piece broken off and separate from the joining part of the third embodiment mold piece.

Once a full array of assemblies 6B are mounted on the respective pairs of clips 268 in order to fill rack 2B and form an electroplating assembly, system 250 is ready to undergo the electroplating process. As with the previous embodiments, FIG. 32 shows that the central surface 138A has been plated with a thin layer or plate P of metal. FIG. 32 also shows that each of the final shape parts have been severed or broken off along the respective sever zones from joining part 122B to produce two finished electroplated parts 120B1F and 120B2F.

Figure 33:
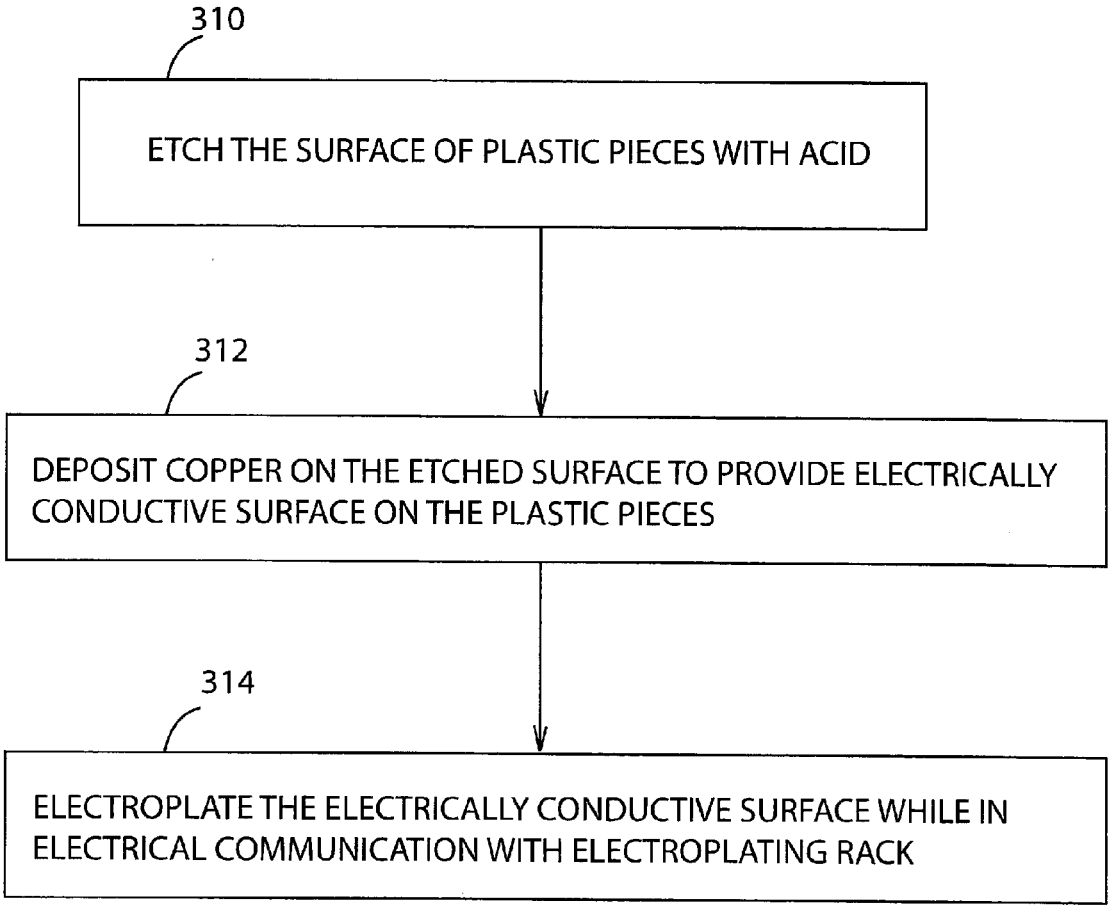
FIG. 33 is a flowchart showing a basic electroplating process.

Referring now to FIG. 33, the electroplating process is described with respect to each of systems 1, 200 and 250. Although the general electroplating process is standard, the electroplating of pieces 4, 4A and 4B is distinct. As shown at block 310, the exposed surfaces of pieces 4, 4A and 4B are etched with acid. Then, as shown at block 312, copper is deposited on the etched surfaces so that the etched surfaces become exposed electrically conductive surfaces. These electrically conductive surfaces of pieces 4, 4A and 4B are then generally ready to be electroplated. When the pieces are joined to form a given assembly 6, 6A or 6B, the electrically conductive surfaces of the pieces are thus in electrical communication with one another, with the electrically conductive surfaces of each adjacent pair of contacting pieces of the assembly in electrical contact with one another and/or electrically conductive adhesive 186. In addition, the electrically conductive surfaces of the pieces are in electrical communication with the electrically conductive members of the corresponding rack 2, 2A or 2B via electrical contact with the corresponding skewer 62, 62A or clips 268. In the case of rack 2, this electrical contact is between the surfaces of pieces 4 which are in contact with skewer 62 and between inner end 156 of innermost piece 4 and outer surface 68 of member 60, as previously described. In the case of rack 2A, this electrical contact is between the surfaces of pieces 4A which are in contact with rod 201 of skewer 62 within notches 202 and between inner end 206 of innermost piece 4A and outer surface 68 of member 60, as previously described. In the case of rack 2B, this electrical contact is between the surfaces of the left and right end pieces 4B which are respectively in contact with the right and left clips 268, as previously described; in the exemplary embodiment, this is the only electrical contact between assembly 6B and the electrically conductive members of rack 2B. Due to the electrical communication between each assembly 6, 6A or 6B and the corresponding rack 2, 2A or 2B, an electrical pathway is provided from the hooks of the given rack to all the electrically conductive surfaces of the corresponding pieces 4, 4A or 4B whereby the pieces within these assemblies are prepared to be electroplated. More particularly, as shown at block 314 of FIG. 33, the electrically conductive surfaces of the pieces 4, 4A or 4B are electroplated while in electrical communication with the respective rack 2, 2A or 2B. While FIG. 33 shows a basic process of electroplating, it is noted that systems 1, 200 and 250 may be used with any suitable electroplating process known in the art.

Thus, each of systems 1, 200 and 250 provide racks and pieces which substantially reduce or eliminate the use of clips for a given rack relative to the number of pieces which are electroplated while being carried on a given rack. The configuration of the various assemblies of pieces and racks also increases the speed with which the pieces may be loaded onto and unloaded from the given rack.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An electroplating system comprising:

an electroplating rack comprising a first electrically conductive member and a second electrically conductive member spaced from the first conductive member;

a joined assembly including a first plastic piece in contact with the first conductive member at a first connection, a second plastic piece in contact with the second conductive member at a second connection, and at least one intermediate plastic piece between the first and second pieces whereby the first and second connections are the only connections between the joined assembly and the rack;

wherein said first, said second and said at least one intermediate plastic pieces are identical to each other and are movable between an unjoined position and a joined position;

wherein each of the plastic pieces comprises:

a joining part and a final shape part secured to the joining part at a sever zone; said sever zone having a material thickness less than a thickness of said joining part and of said final shape part;

said final shape part extending outwardly away from the joining part, said final shape part forming a plastic piece being electroplated;

and wherein said joining parts of each of said first, second and at least one intermediate pieces form a rod attached at one end to one side of the rack and at another end to another side of the rack when said first, second, and at least one intermediate plastic pieces are in said joined position.

2. The system according to claim 1, wherein said joining part comprises an elongate body having a first end and a second end, wherein said first end is sized and otherwise dimensioned to attach to a second end of an adjacent piece; and said joining part further includes a neck portion extending from said elongate body; the sever zone formed at an interface of said neck portion and said final shape part, said sever zone adapted to sever upon application of a predetermined force such that said final shape part can be removed from the assembly by permanently severing the plastic piece at said sever zone.

3. The system according to claim 2, wherein said first end of said joining part comprises an insert portion extending outwardly from a shoulder portion of said first end; said insert portion having a smaller width than said shoulder portion.

4. The system according to claim 3, wherein said insert portion has a non-circular cross-section.

5. The system according to claim 4, wherein said second end comprises a cavity for receiving therein said insert portion.

* * * * *